US005618068A

United States Patent [19]

Mitsui et al.

[11] Patent Number: 5,618,068

[45] Date of Patent: Apr. 8, 1997

[54] DOOR LOCK APPARATUS WITH AUTOMATIC DOOR CLOSING MECHANISM

[75] Inventors: Jiro Mitsui; Hirofumi Watanabe; Yoshihiko Fujihara, all of Yamanashi-ken, Japan

[73] Assignee: Mitsui Kinzoku Kogyo Kabushiki Kaisha, Tokyo, Japan

[21] Appl. No.: 223,510

[22] Filed: Apr. 6, 1994

[30] Foreign Application Priority Data

| | | | |
|---|---|---|---|
| Apr. 7, 1993 | [JP] | Japan | 5-105124 |
| Apr. 26, 1993 | [JP] | Japan | 5-121893 |
| Jul. 20, 1993 | [JP] | Japan | 5-200398 |

[51] Int. Cl.[6] ..... E05C 3/26

[52] U.S. Cl. ..... 292/201; 292/216

[58] Field of Search ..... 292/201, 216, 292/336.3, DIG. 23

[56] References Cited

U.S. PATENT DOCUMENTS

| | | | |
|---|---|---|---|
| 4,364,249 | 12/1982 | Kleefeldt | 292/DIG. 23 |
| 4,762,348 | 8/1988 | Matsumoto | 292/DIG. 23 |
| 4,986,579 | 1/1991 | Ishikawa | 292/216 |
| 5,020,838 | 6/1991 | Fukumoto | 292/216 |
| 5,028,084 | 7/1991 | Fukumoto et al. | 292/201 |
| 5,106,133 | 4/1992 | Fukumoto et al. | 292/DIG. 23 |
| 5,137,311 | 8/1992 | Brackmann | 292/216 |
| 5,146,772 | 10/1992 | Hamada et al. | 292/201 |
| 5,236,234 | 8/1993 | Norman | 292/216 |
| 5,273,324 | 12/1993 | Kobayashi | 292/216 X |

FOREIGN PATENT DOCUMENTS

| | | |
|---|---|---|
| 3115676 | 5/1991 | Japan . |
| 1431580 | 4/1976 | United Kingdom . |
| 2196381 | 4/1988 | United Kingdom . |

*Primary Examiner*—Peter M. Cuomo
*Assistant Examiner*—Monica E. Millner
*Attorney, Agent, or Firm*—Browdy and Neimark

[57] ABSTRACT

A door lock apparatus with automatic door closing mechanism comprises a latch engaging with a striker secured to a vehicle body, an automatic door closing motor for over-rotating the latch at its half-latched position beyond its full-latched position while the motor rightly rotates, a switch adapated to turn to continuously ON when the latch is between the half-latched and full-latched positions and turn to OFF when the latch is at other position than between the half-latched and full-latched positions, and a controller for rightly rotating the motor when door closing operation turns the switch from its OFF condition to ON condition and reversely rotating motor when the switch turns from ON to OFF.

12 Claims, 19 Drawing Sheets

A
B
9
36
40
58
59
60
61
63
66
69
71
72
73
74
78
79
80
81
82
83
86
89
90
91
92
93
94
95
96
97
98
99
100
104
107
108
109
110
111
113
114
115
117
119
120
121
122
123
131

DOOR LOCK APPARATUS WITH AUTOMATIC DOOR CLOSING MECHANISM

FIELD OF THE INVENTION

The present invention relates to a door lock apparatus with automatic door closing mechanism which enables complete closing of a door using the power of a motor after the door has been manually closed halfway.

PRIOR ART

According to the conventional known door lock apparatus with automatic door closing mechanism described in Japanese Pat. Appln. Laid-open No. 3-115676, the apparatus comprises a latch engaging with a striker secured to the vehicle body, an automatic door closing motor, a power transmitting or communication mechanism provided between the motor and the latch in order to compulsorily rotate the latch along its full-latched direction when the motor rightly rotates, a switch detecting the latch at its half-latched position and its full-latched position, and a controller controlling the motor on the basis of signal issued from the switch, said controller rightly rotates when the switch detects its half-latched position so as to move the latch along its full-latched direction through the power communication mechanism and reversely rotates when the switch detects its full-latched position.

First problem of the conventional door lock apparatus relates to construction of the switch detecting position of the latch. As shown in FIG. 30 depicting relation between the conventional switch and the latch. When the door manually is closed and the latch (a) becomes at its half-latched position, the ratchet (b) rotates counterclock and engages with a sub stepped portion (c) of the latch (a). When ratchet (b) rotates, switch (d) turns ON, so that the motor (e) rightly rotates and the power communication mechanism (f) reversely rotates the latch (a). After the latch (a) rotates, the ratchet (b) comes out of the sub stepped portion (c) and rides on a slanted face (g) resulting in OFF condition of the switch (d). When the latch (a) further rotates and reaches its full-latched position, the ratchet (b) engages with a main stepped portion (h). Consequently, switch (d) turns again )N and the motor (e) reversely rotates returning the power communication mechanism (f) to its initial position.

According to the conventional known lock apparatus, first ON condition of the switch (d) is considered as its half-latched condition and next ON condition of the switch is considered or presumed as its full-latched condition. It is noted that it is not always that the second ON condition of the switch is its full-latched one. That is, when the door is closed with relatively weak force, the latch (a) may return to its half-latched position after it rotates to a mid position between a half-latched position and a full-latched one of the latch (a). It is the reason for the door being not closed completely and being at its half-latched condition.

When the latch (a) rotates as described above, the ratchet (b) engages with the sub stepped portion (c) and rides on a slanted face (g), then again engages with the sub stepped portion (c). Thereby, switch (d) outputs ON signal twice. In this condition, notwithstanding the latch (a) is at its half-latched condition, the motor (e) reversely rotates and it is impossible to hope obtaining satisfied or complete automatic door closing operation.

The second problem of the conventional door lock apparatus concerns that the motor is rightly rotated and the latch is rotated along its full-latched direction when the latch becomes of full-latched condition. As shown in FIG. 30, a power communication mechanism (f) used also as a speed reduction mechanism is provided between the latch (a) and motor (e). The power communication mechanism (f) fails sometimes to attain satisfied or good function if it doesn't return to its initial position when the motor (e) rightly rotates.

Some of the conventional door lock apparatus have been improved so as to be used in doors opening and closing by sliding on the vehicle body.

In case of slide type door, particular structure of the door has some restrictions and problems, so that it has been impossible to directly connect the battery to automatic door closing mechanism by means of electric cable. As a result, necessary power can be supplied to the automatic door closing mechanism by securing a first connector connected to a battery to the vehicle body and securing a second connector connected to automatic door closing mechanism to the door. When the door is closed to its half-latched position, both the first and second connectors are connected to each other supplying power to the automatic door closing mechanism.

At least, both connectors respectively have plus terminal and earth terminal and each terminal is ecposed, so that they are contacted to each other when the door is closing. Because plus terminal and earth terminal are exposed, water or metal chips come into contact with the exposed terminal introducing short-circuits. And it is dangerous to constantly connect the plus terminal of the first connector to other plus terminal of battery. According to the conventional technique solving the problem above, a relay terminal is provided between the plus terminal of first connector and battery, and the relay is adapted to close when a switch provided on the vehicle body is pushed through the door turning the switch ON. Thus, power is supplied to the automatic door closing mechanism through the second connector only when the mechanism necessitates power.

However, it is very difficult to precisely coincide an instance of the switch turning ON with instance of both the connectors coming practically into contact with each other. If the switch is not precisely secured, a timing or instance of supplying power to the automatic door closing varies very much from the right one. In addition, movable contacts of such switch are provided in exposed condition resulting in low reliability and mulfunctioning.

PURPOSE OF THE INVENTION

Consequently, a purpose of the present invention is to provide a door lock apparatus with automatic door closing mechanism having a switch which detects positions of the latch. The switch has its OFF condition between an open position and half-latched position, its ON condition between the half-latched position and a full-latched position, and its OFF condition between full-latched position and an over-rotated position in order to make control of automatic door closing smooth.

It is another purpose of the present invention to provide a door lock apparatus with automatic door closing mechanism having a power communication mechanism provided between a latch and a motor wherein automatic door closing is done after the power communication mechanism returns to its initial position in order to attain a reliable automatic door closing.

Further, it is still another purpose of the present invention to provide a door lock apparatus with automatic door closing mechanism for use in a slide type door.

BRIEF DESCRIPTION OF THE DRAWING

Other features and advantages of the invention will be apparent from the following description taken in connection with the accompanying drawings wherein.

DESCRIPTION OF THE PREFERRED EMBODIMENT

Figure 1:
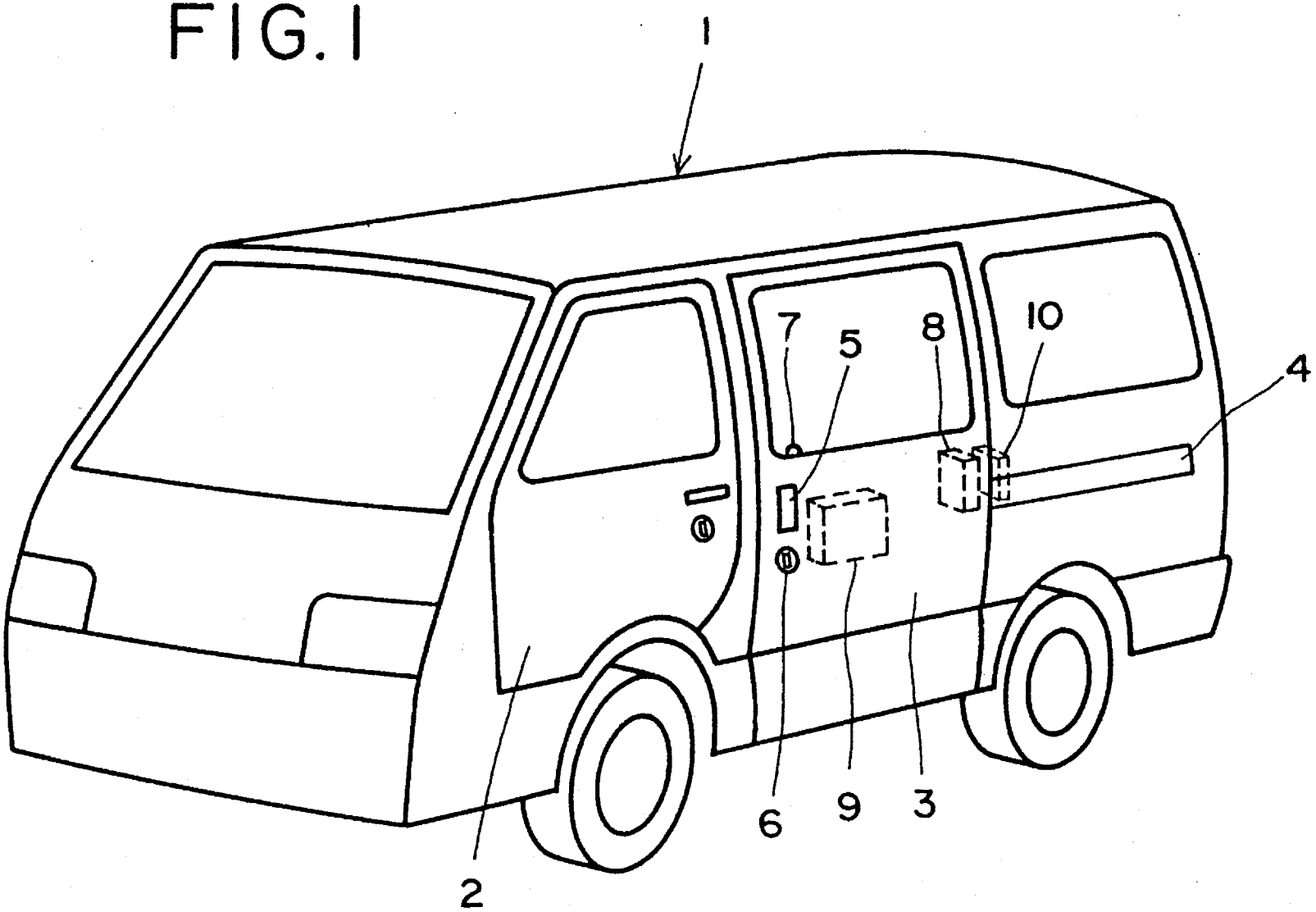
FIG. 1 is an explanation view of whole construction and arrangement of the door lock apparatus with automatic door closing mechanism of the present invention.
Figure 2:
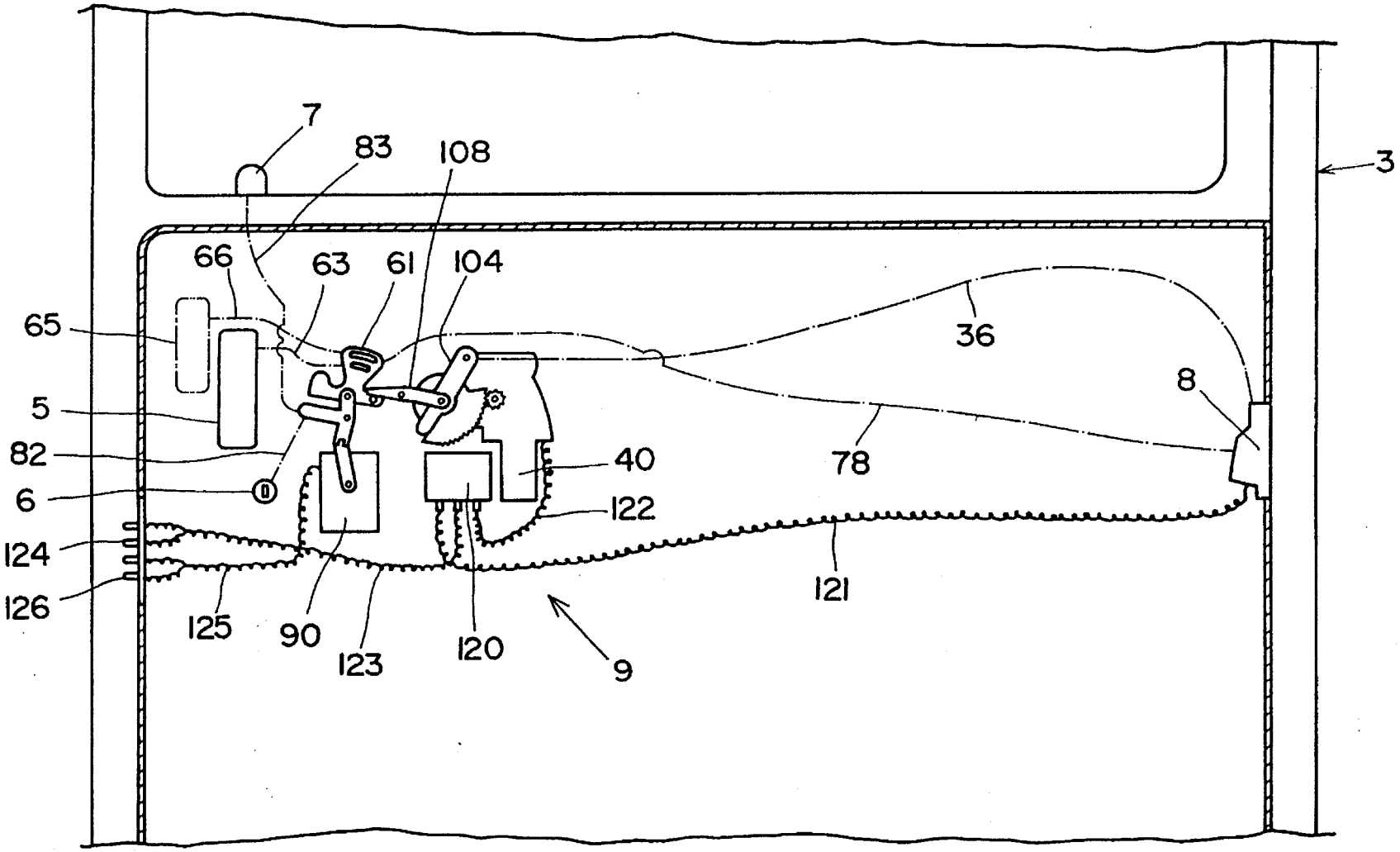
FIG. 2 is a sketch depicting interior of slide type door.

An embodiment of the door lock device with automatic door closing mechanism according to the present invention will be described with reference to the accompanying drawings. As shown in FIG. 1, a vehicle body 1 of one-box type has a front side swing type door 2 and a slide type door 3 closed and opened by moving along a guide rail 4 of the vehicle body 1, which rail extends in front-and-rear direction. The slide type door 3 is provided with a latch mechanism 8 adapted to engage with a striker 10 secured to the vehicle body 1, an outer handle 5, a key cylinder 6, an inside lock member 7, and operation mechanism 9.

Figure 27:
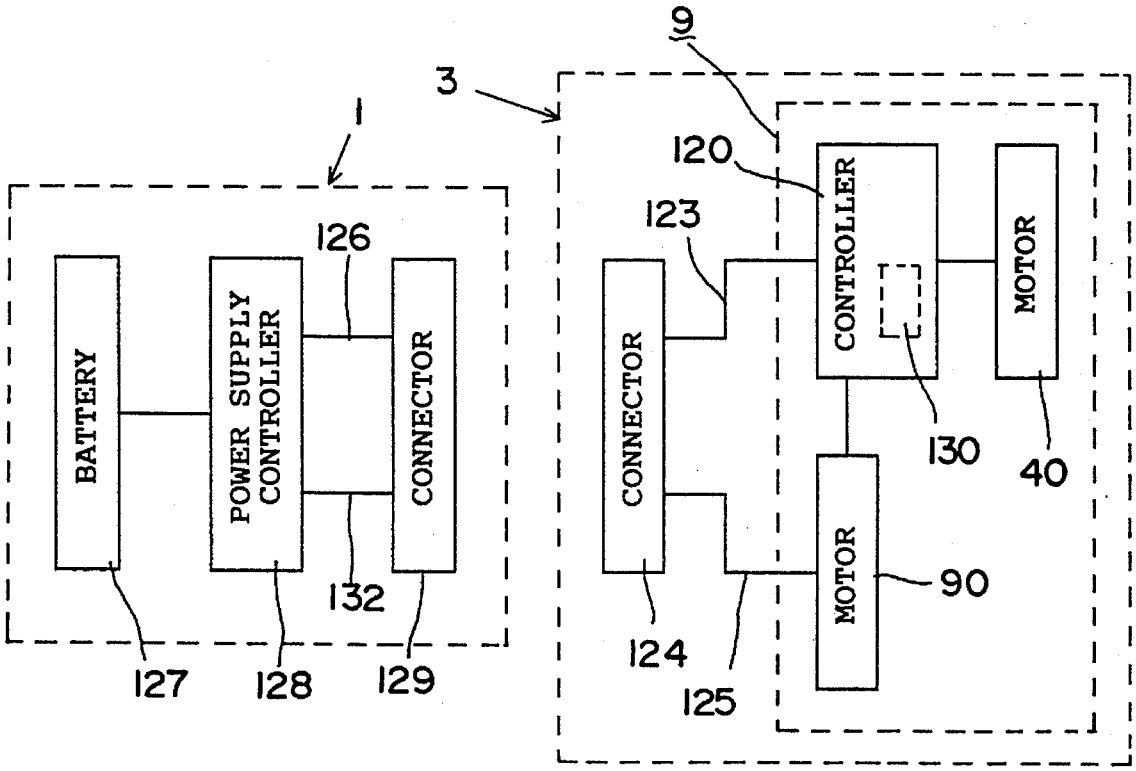
FIG. 27 is a block diagram of power supply controller of the vehicle body and the automatic door closing the controller of door.

As will be described later and shown in FIG. 27, the vehicle body 1 has a connector 129 connected to a battery 127 through an electricity supply controller 128. The slide type door 3 has a connector 124 connected to an automatic door closing controller 120 of the operation mechanism 120. The connectors 129 and 124 do not contact each other when the door 3 is at its open condition. While the door 3 is open, power of the battery 127 is not supplied to the automatic door closing controller 120. When the door 3 moves to its closed position, both the connectors 129 and 124 contact each other and the power of the battery 127 is supplied to the automatic door closing controller 120 through the electricity supply controller 128. Then the controller 120 rotates an automatic door closing motor 40 of operation mechanism 9, wherein the door 3 is compulsorily closed.

The latch mechanism 8 will be explained with reference to FIG. 3 to FIG. 10. A synthetic resin made body 11 of the latch mechanism 8 has an accommodation space 12 formed on a front side of the body 11. A latch 13 and ratchet 14 are rotatably attached in the accommodation space 12 through shafts 15 and 16. The body 11 has a passage 17 transversely extending through which the striker 10 enters. A shaft hole 18 through which the latch shaft 15 passes is formed above the passage 17.

Figure 4:
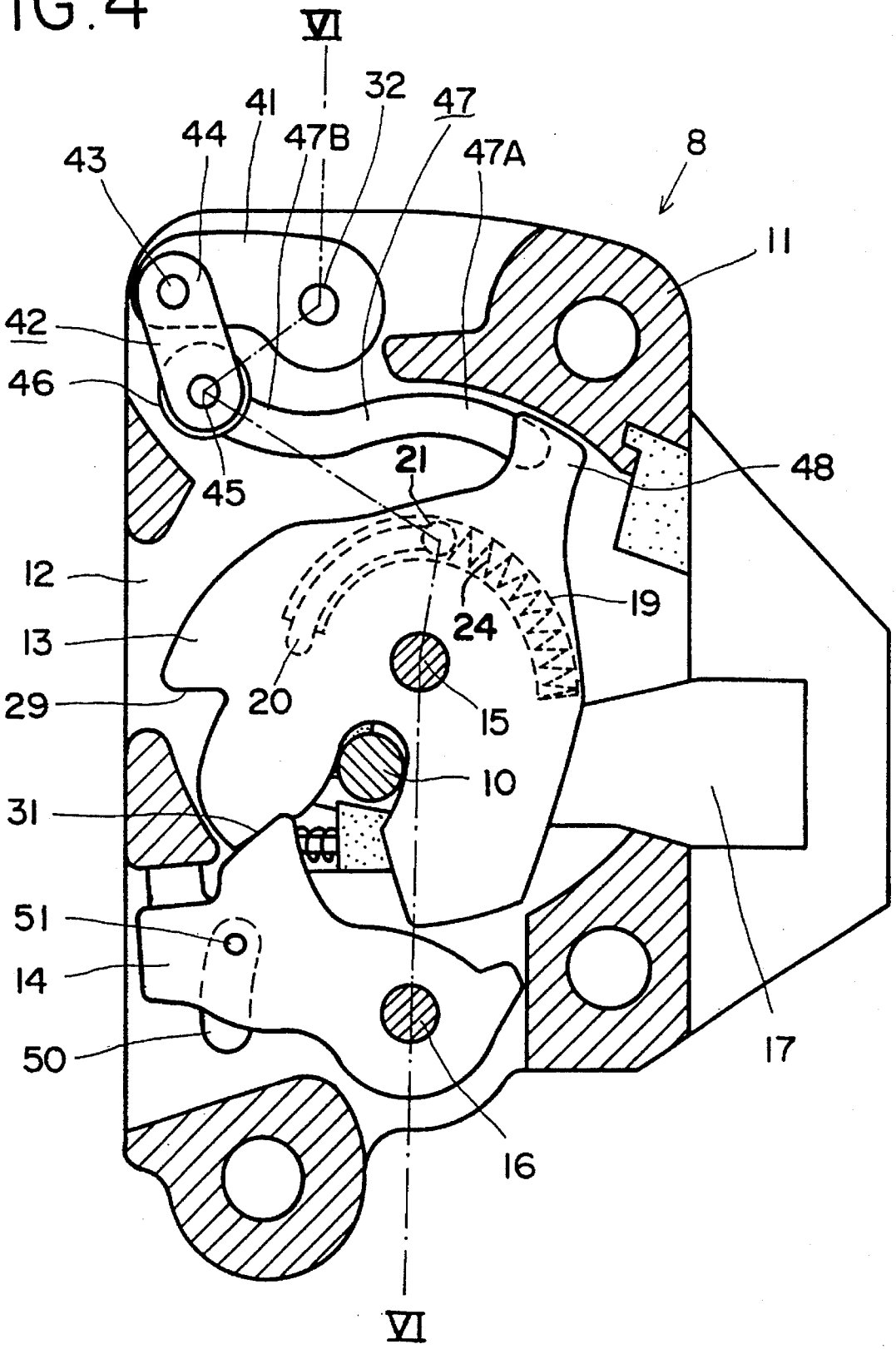
FIG. 4 is a front view of the latch and ratchet equipped on the body of the latch mechanism.
Figure 5:
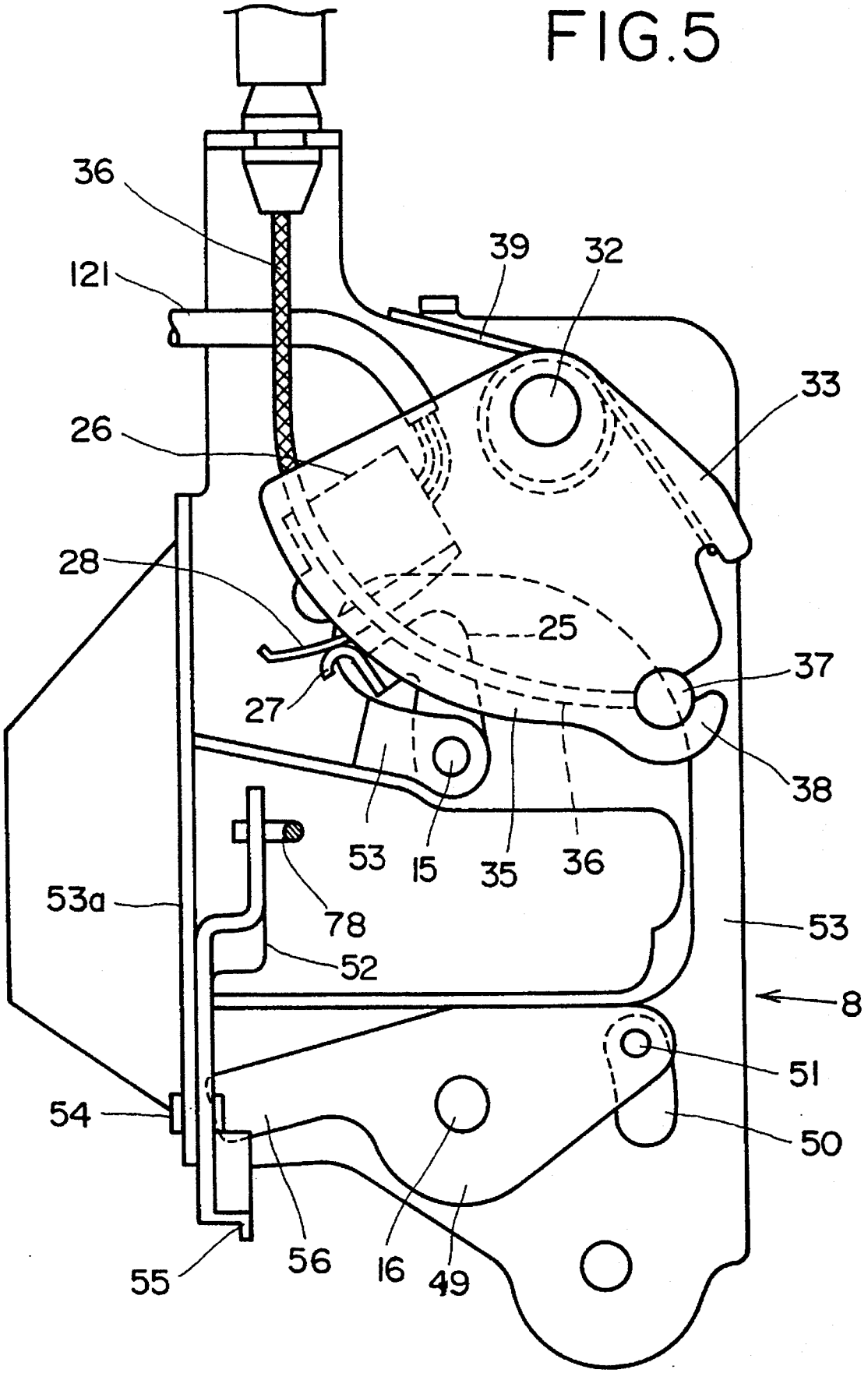
FIG. 5 is a rear view of the latch mechanism.
Figure 6:
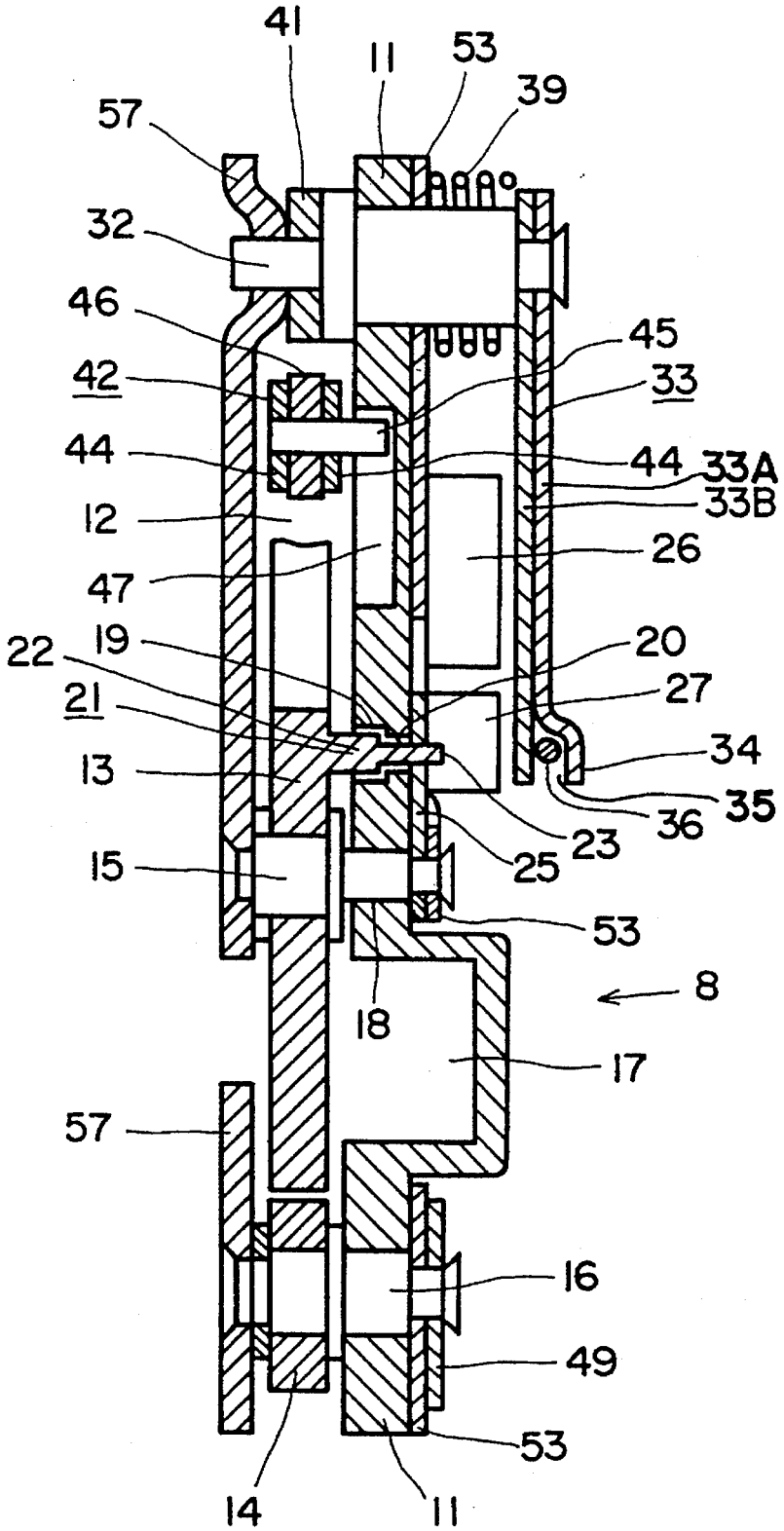
FIG. 6 is a section taken along line VI—VI of the latch mechanism.

As clearly shown in FIG. 3 through FIG. 6, the latch 13 has a stepped pin 21 formed on its rear side. The stepped pin 21 consists of a thick pin portion 22 and a thin pin portion 23 formed on a front end of the thick pin portion 22. The thick pin 22 is adapted to be inserted in an arc groove 19 of a radius around the shaft hole 18 and the thin pin 23 is inserted through an arc hole 20 formed at a bottom of the arc groove 19. As shown in FIG. 6, the arc hole 20 is in a shape of through hole and thin pin portion pin 23 protrudes to rear side of the body 11 through the arc hole 20. The arc groove 19 contains a coil spring 24 pushing the thick pin portion 22 so as to urge the latch 13 counterclockwise in FIG. 4.

An L shaped latch arm 25 is arranged on rear side of the vehicle body 11. The latch arm 25 is rotatably journalled with the latch shaft 15. A front end portion of the latch arm 25 engages with an end portion of the thin pin portion 23 in order to rotate the latch arm 25 together with latch 13. A switch 26 detecting rotational position of the latch 13 is placed above the latch arm 25. When the latch arm 25 rotates and bent portion 27 of the latch arm 25 pushes the switch arm 28, the switch 26 is turned ON. In addition, a back plate 53 is attached on rear side of the body 11 and the latch arm 25 is placed between the back plate 53 and the body 11. A cover plate 57 is attached on front side of the body 11.

Figure 7:
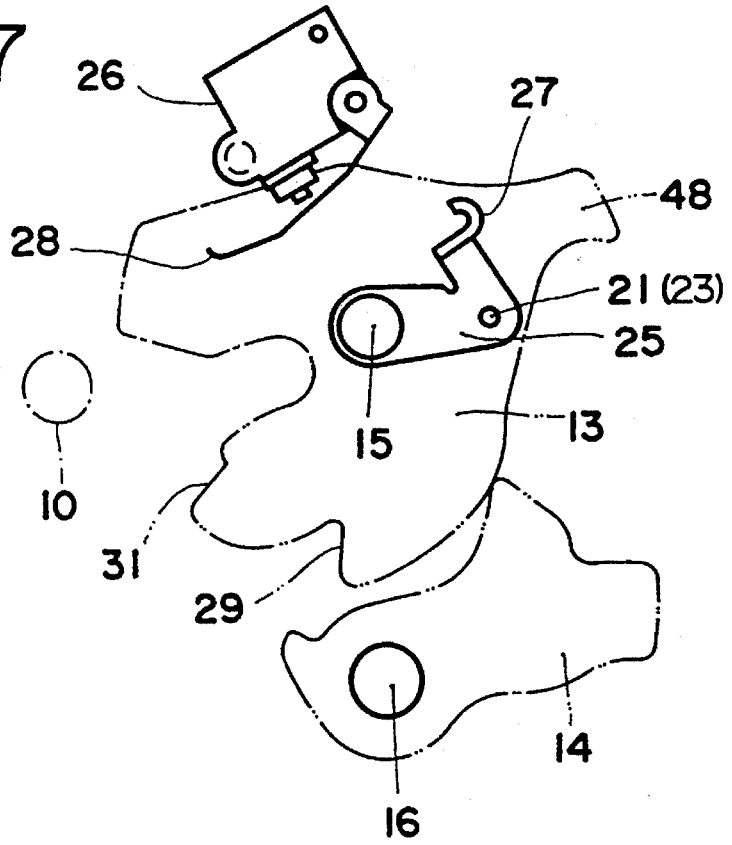
FIG. 7 is a relation view of the switch and a latch at its open position.
Figure 8:
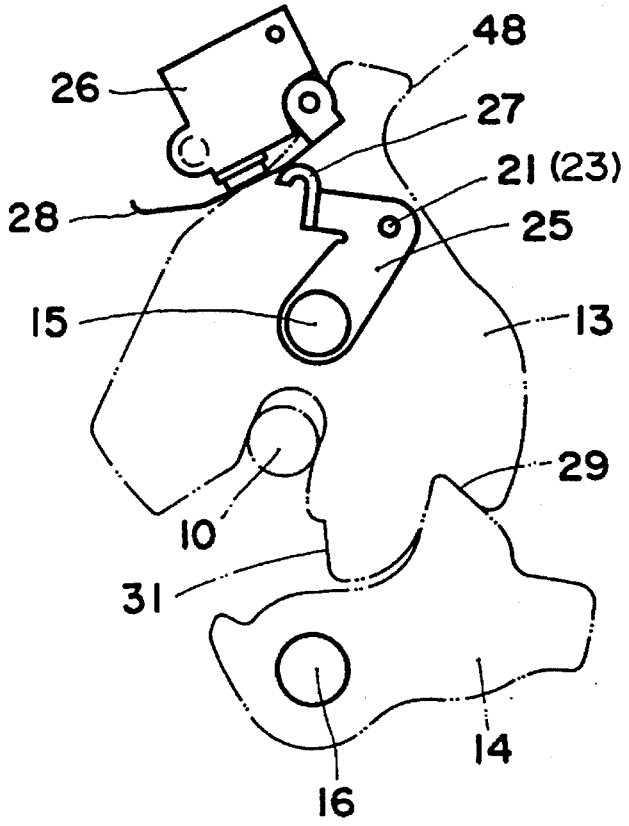
FIG. 8 is a relation view of the switch and a latch at its half-latched position.
Figure 9:
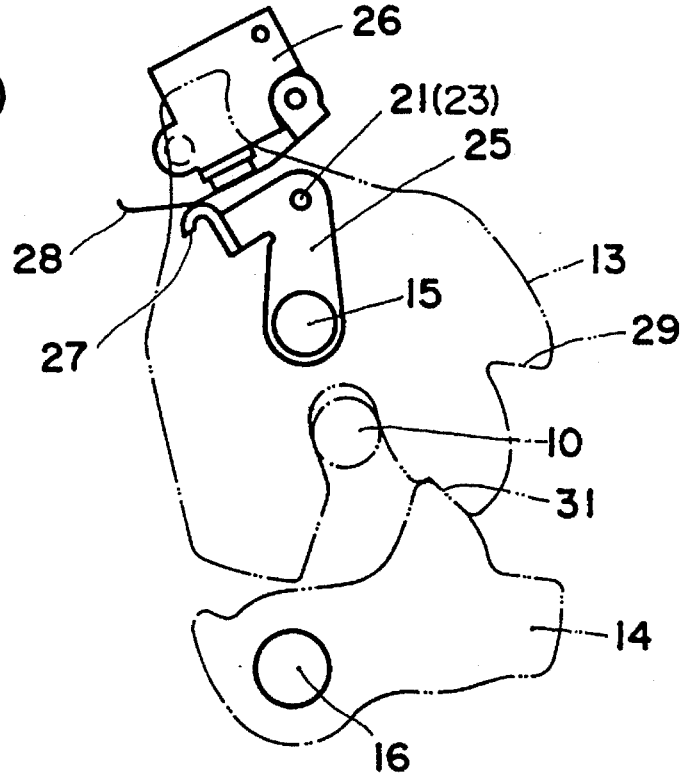
FIG. 9 is a relation view of the switch and latch at its full-latched position.
Figure 10:
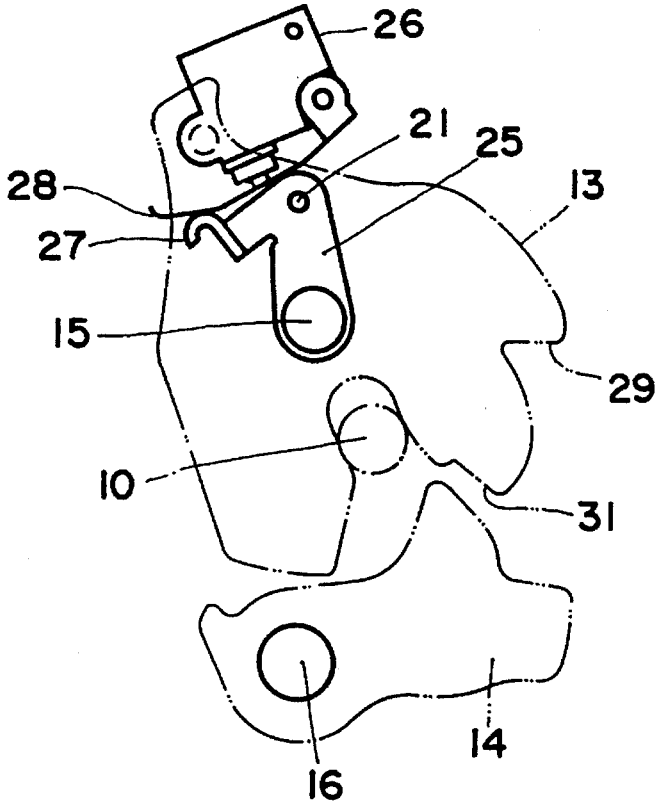
FIG. 10 is a relation view of the switch and latch at its over-rotated position.
Figure 11:
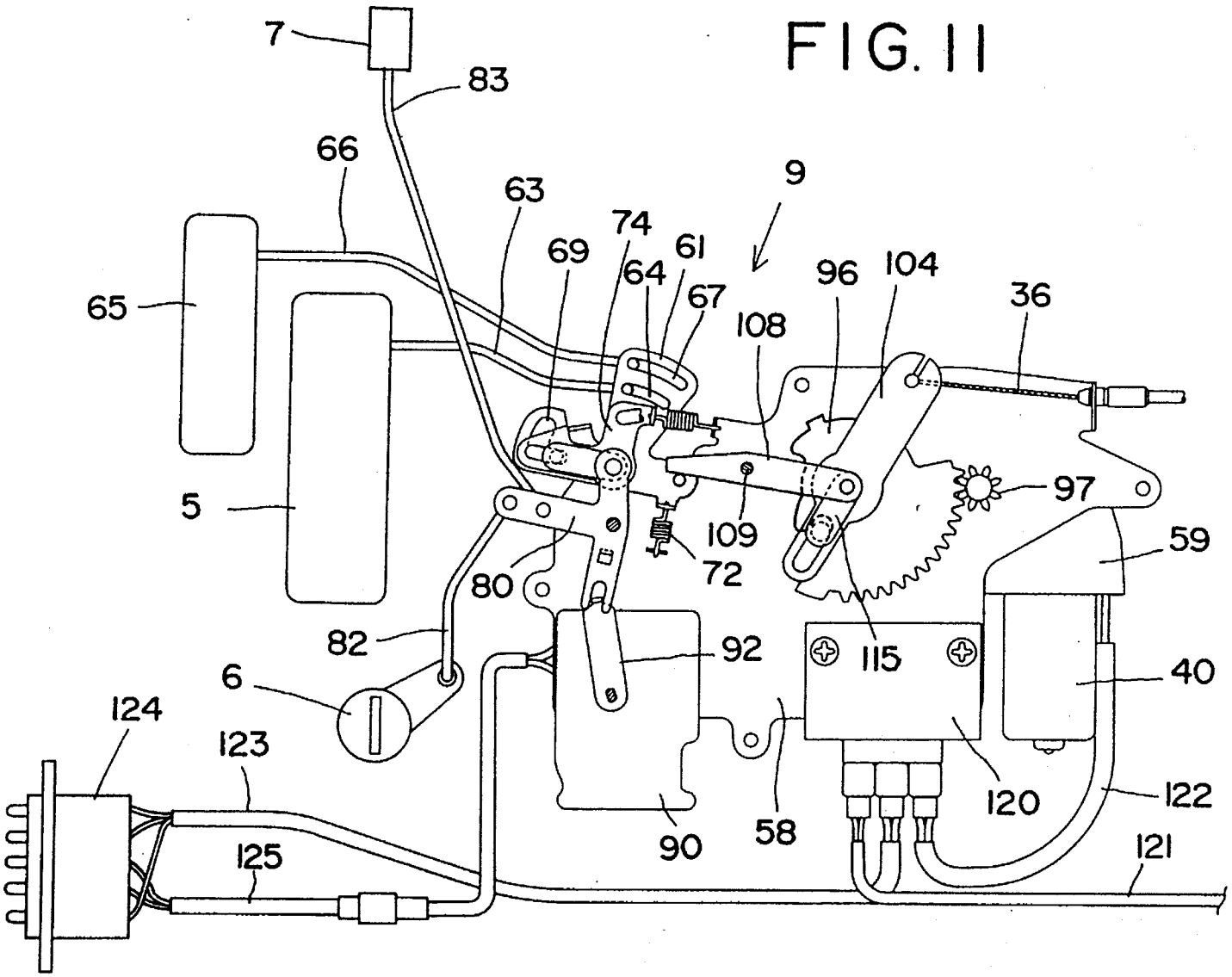
FIG. 11 is a whole view of the operation mechanism.

FIG. 7 through FIG. 10, respectively show the relationship of rotation positions of latch 13 (latch arm 25) to the switch 26. FIG. 7 shows the latch 13 at its open position. The bent portion 27 of the latch arm 25 is separated from the switch arm 28 and the switch 26 is at OFF position when the latch 13 is at its open position. FIG. 8 shows latch 13 at its half-latched position and ratchet 14 engaging with sub-stepped portion 29 of the latch 13. In such position, the bent portion 27 pushes switch arm 28 and the switch 26 is turned ON. FIG. 9 depicts the latch 13 at its full-latched position and the ratchet 14 engages with the main-stepped portion 31 of latch 13. Even at such condition, switch arm 28 is pushed over the bent portion 27 and switch 26 is still at its ON condition. FIG. 10 shows latch 13 at its over-rotated position. At this condition, bent portion 27 is separated from the switch arm 28 and switch 26 is turned to its OFF position. In short, switch 26 is at its ON position when latch 13 is moved between a half-latched position and full-latched position and at its OFF position when latch 13 is placed at the position other than one above. The automatic door-closing controller 120 controls rotation of the motor 40 according to signals from the switch 26.

Additionally, the timing for exchanging the switch can be finely adjusted relative to timing of the half-latched position and full-latched position of the latch 13 according to various conditions of kind and weight of the vehicle door. Generally, the switch 26 is turned ON a little early before reaching the half-latched position and turned OFF a little later full-latched position.

A rotation shaft 32 is rotatably attached to a place above the vehicle body 11. A fan-like revolution lever 33 is secured to an end portion of the rotation shaft 32. The rotation shaft 32 rotates together with the revolution lever 33. Revolution lever 33 is made by bonding two metal plates 33A and 33B together as shown in FIG. 6. U-shaped groove 35 for guiding a wire 36 is formed on circumferential portion of the clad or bonded metal plates 33A and 33B. A wire head 37 of wire 36 is adapted to engage with a hook 38 formed at an end portion of guide groove 35. The revolution lever 33 is urged along a counterclockwise direction in FIG. 5 by means of a spring 39. Another end of the wire 36 is indirectly connected to the automatic door closing motor 40. When the motor 40 winds up the wire 36, the revolution lever 33 revolves clockwise in FIG. 5 against elasticity of the spring 39.

As shown in FIG. 4, a cooperative lever 41 is secured to front end of the rotation shaft 32. The rotation shaft 32 and cooperative lever 41 integrally rotate through rotation shaft 32. A pressing body 42 is journalled with front end of the cooperative lever 41 by means of a shaft 43. The pressing body 42 consists of a pair of plates 44 and 44, with a roller 46 journalled between both the plates 44 and by a guide pin 45. Rear end of guide pin 45 protrudes toward the vehicle body 11 and is inserted through a guide groove 47 so formed on the body 11 to substantially extend transversely.

Figure 3:
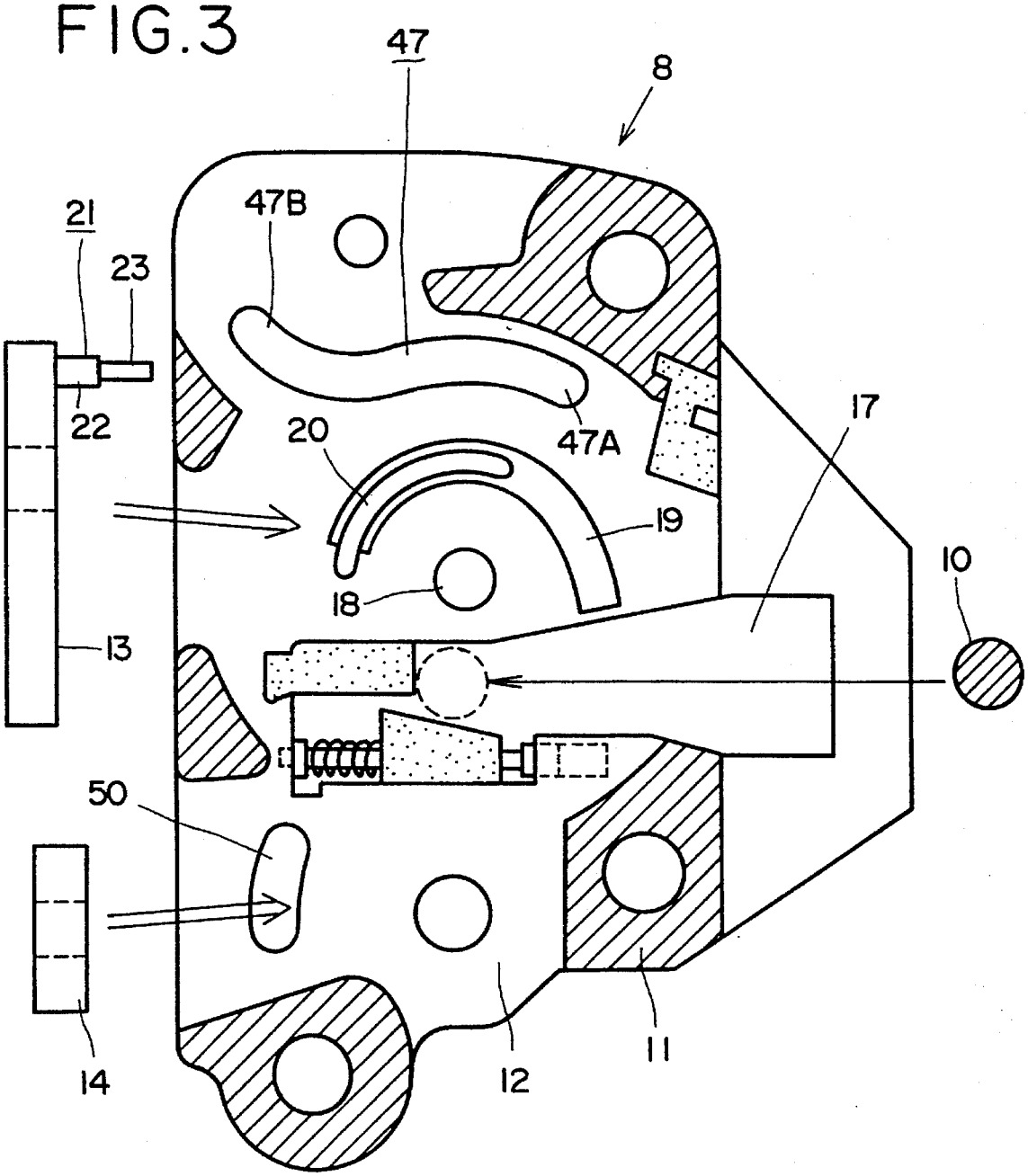
FIG. 3 is a front view of a body of the latch mechanism.

As shown in FIG. 3, a right-half portion of the guide groove 47 is an arc groove 47A of a radius around a center of the shaft hole 18 and a left-half portion of the groove 47 is an escape groove 47B extending along an arc opposed to the shaft hole 18.

The latch 13 has an engagement piece 48. When the latch 13 rotates to a half-latched position, the engagement piece 48 overlaps with left end portion of the arc groove 47A. When the latch 13 rotates to its full-latched position, the engagement piece 48 overlaps with right end portion of the arc groove 47A.

When the latch 13 is placed at its half-latched position and the motor 40 winds up the wire 36, revolution lever 33 and cooperative lever 41 rotate, the pressing body 42 starts to slide from a position of FIG. 4 to the right, and roller 46 of the pressing body 42 engages with an engagement piece 48 of the latch 13 placed at its half-latched position in order to compulsorily rotate the latch 13 along its full latching direction.

As shown in FIG. 5, a ratchet arm 49 rotatably supported on the ratchet shaft 16 at a lower end of body 11. Ratchet arm 49 and ratchet 14 are mutually connected by connection pin 51 passing through hole 50 formed in the body 11. The back plate 53 attached on rear side of the body 11 has a bent portion **53*a* placed at left end side of the back plate 53. Intermediate lever 52 is rotatably journalled with the bent portion 53*a* through shaft 54. Intermediate lever 52 is substantially connected to door opening handle or knob 5 through rod 78. When the handle 5 operates to rotate the lever 52, an end 55 of the lever engages with another end 56 of the ratchet arm 49 in order to rotate clockwise separating ratchet arm 49, thereby ratchet 14 from the latch 13**.

Figure 12:
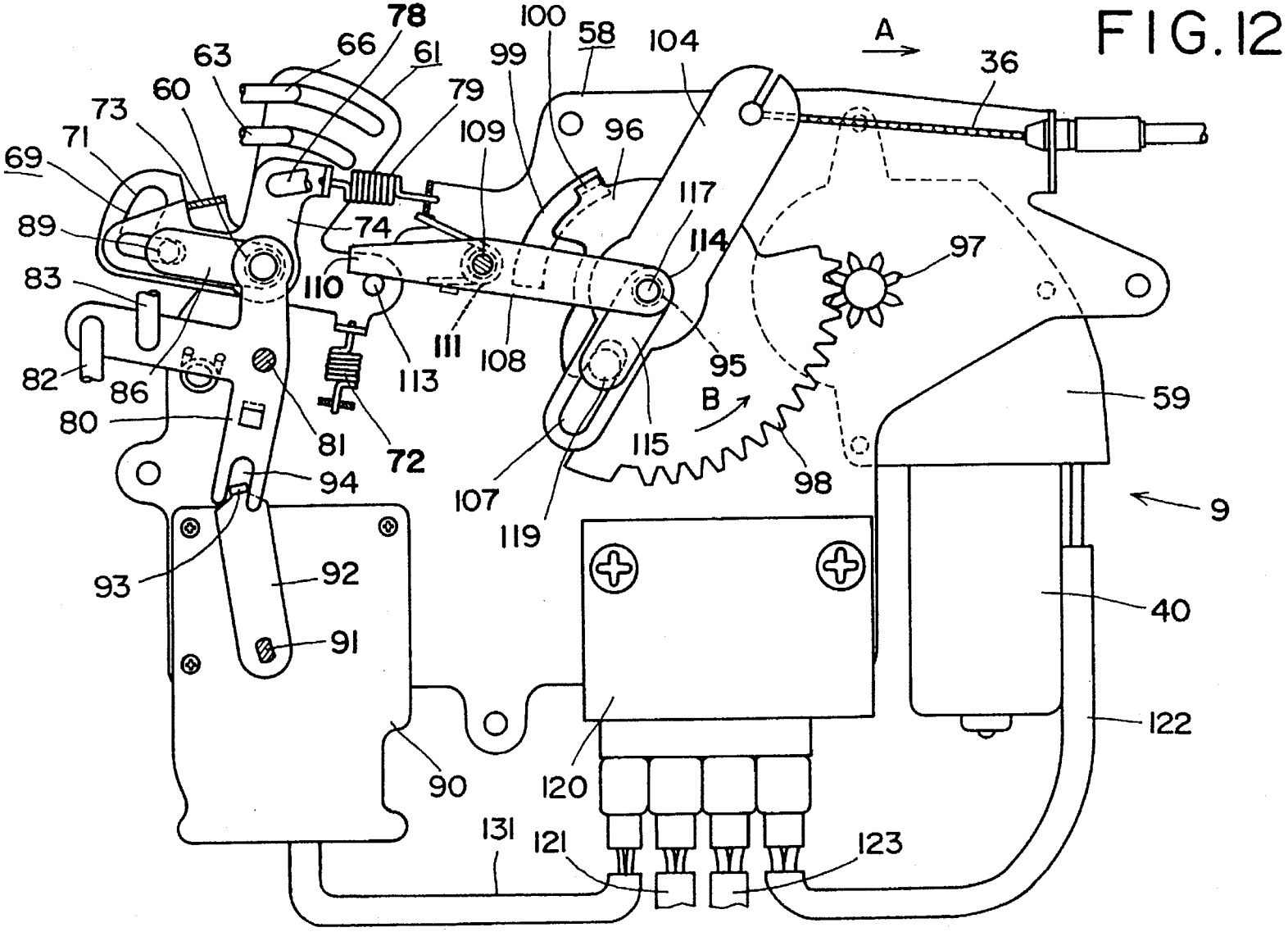
FIG. 12 is a detailed view of the operation mechanism.
Figure 13:
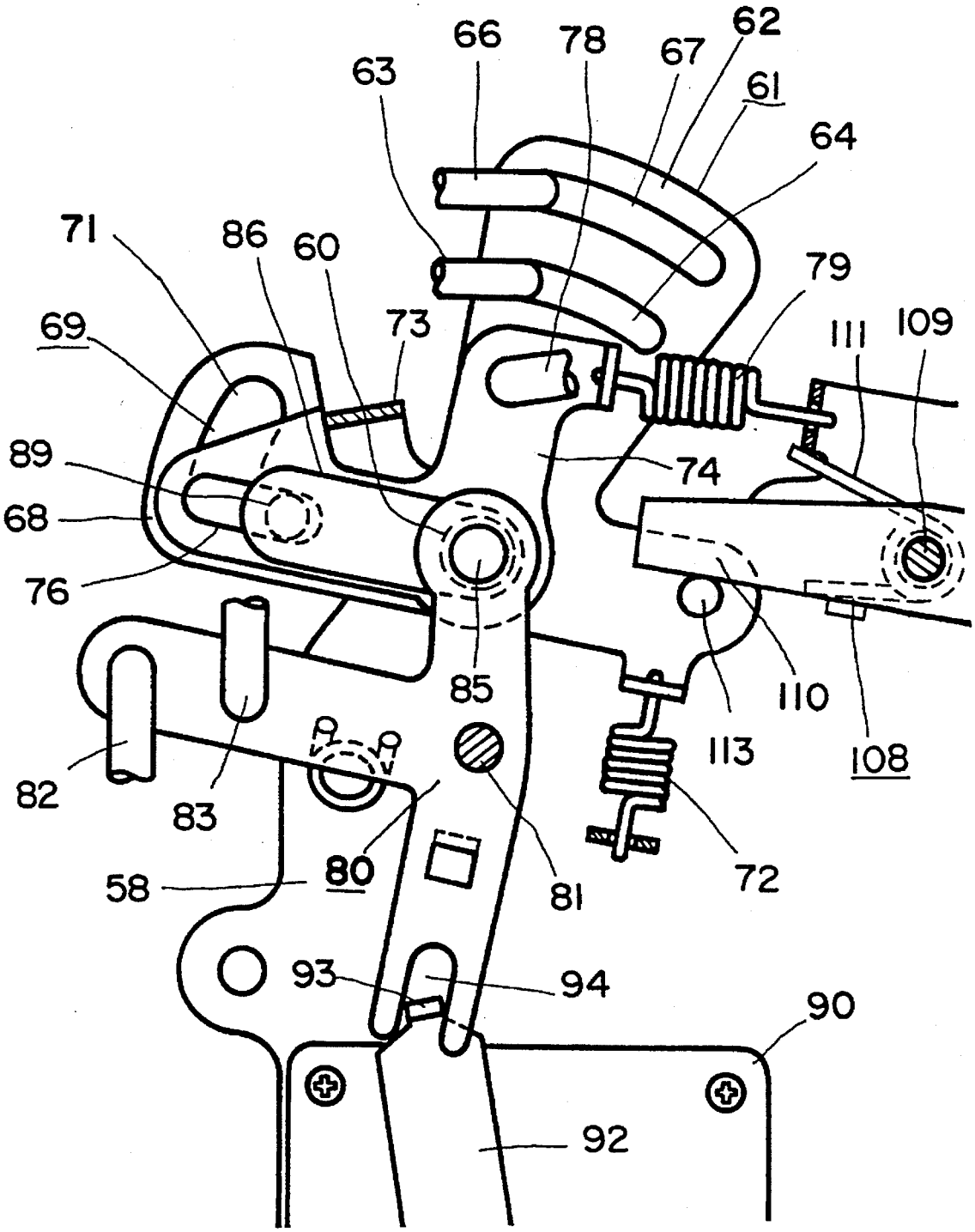
FIG. 13 is an enlarged view depicting the relationship between the open lever, transmission lever and lock lever.
Figure 14:
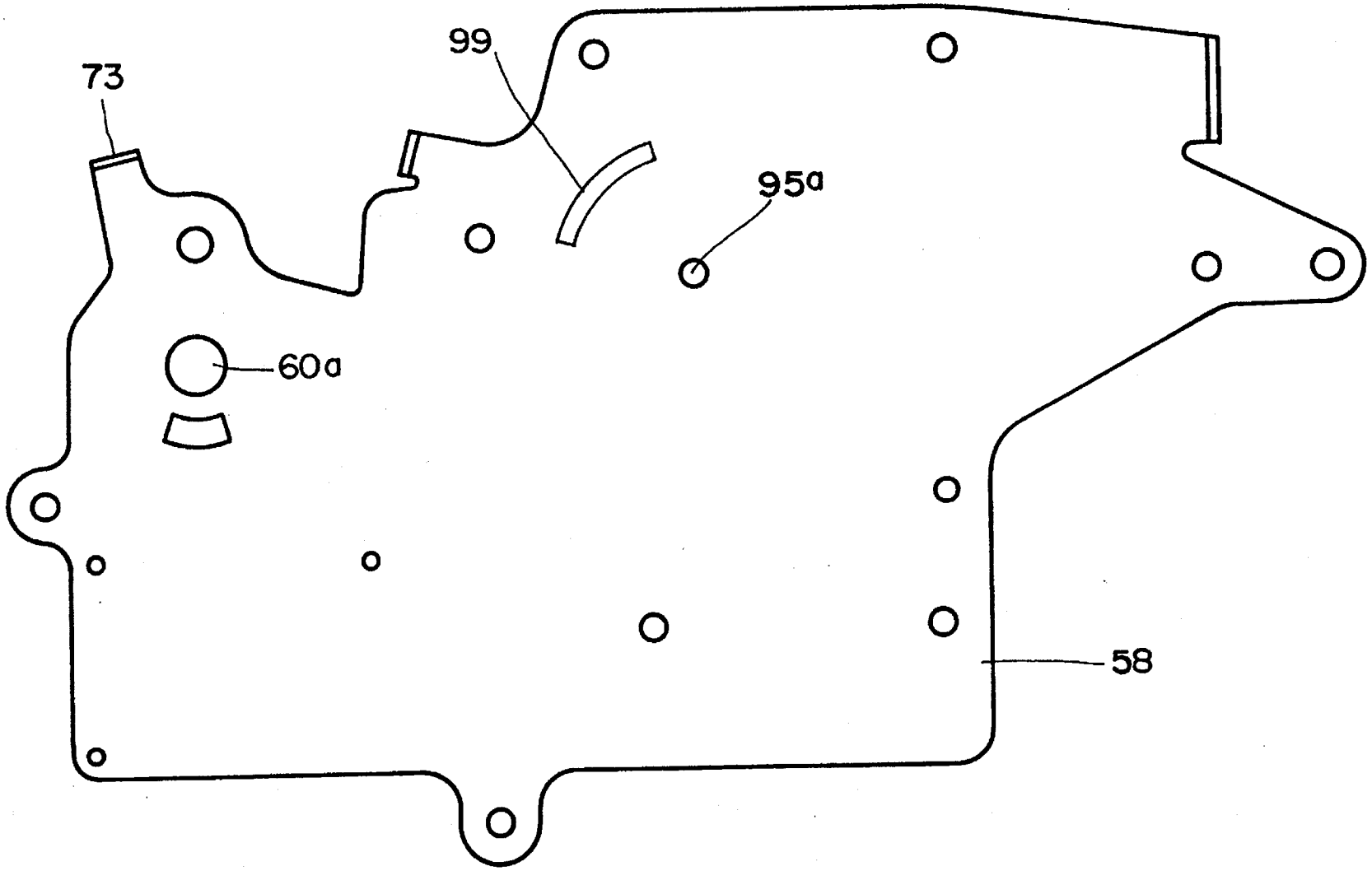
FIG. 14 is a front view of the base frame.
Figure 15:
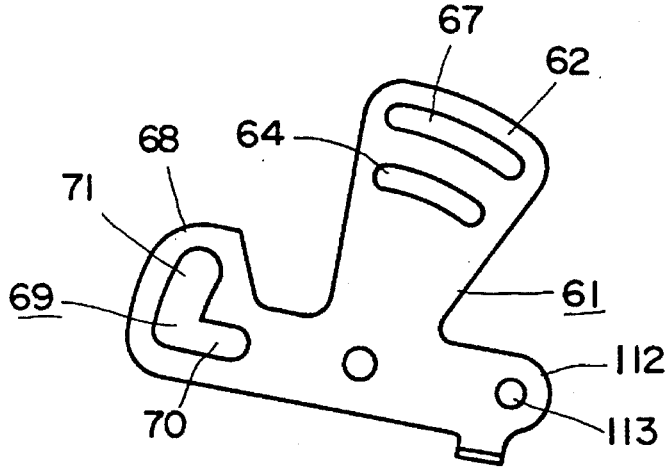
FIG. 15 is a front view of the open lever.
Figure 16:
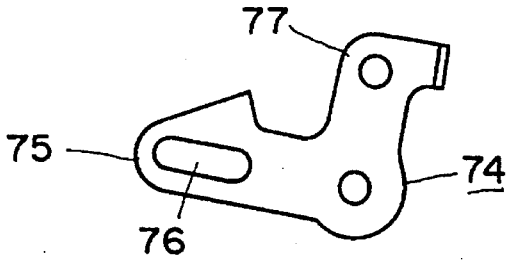
FIG. 16 is a front view of the communication lever.
Figure 17:
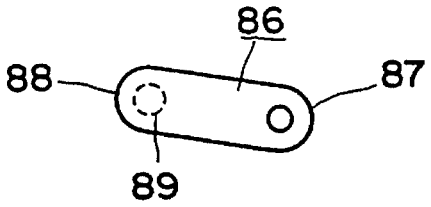
FIG. 17 is a front view of the movement lever.
Figure 18:
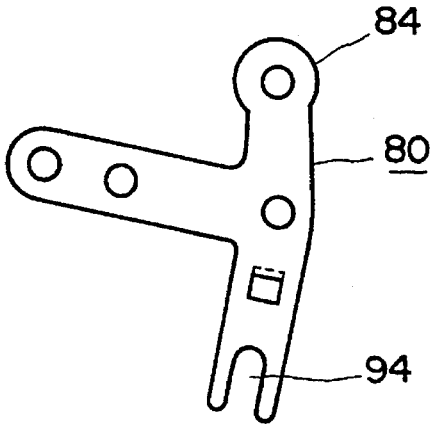
FIG. 18 is a front view of the lock lever.
Figure 19:
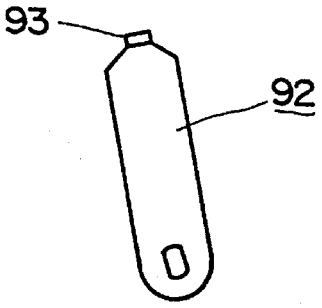
FIG. 19 is a front view of the lever.
Figure 20:
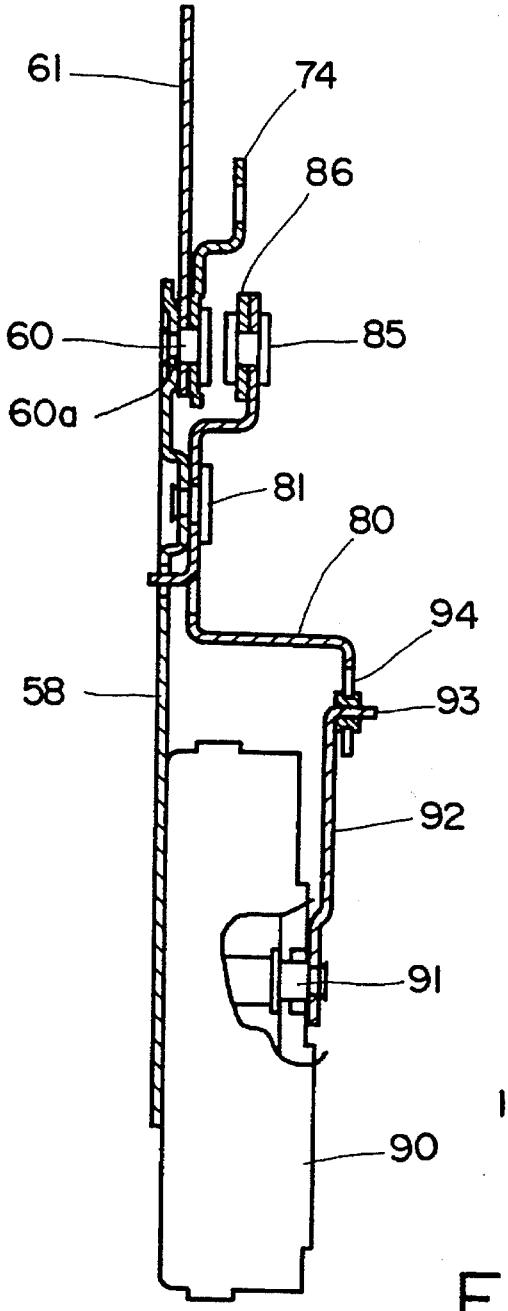
FIG. 20 is a section of the operation mechanism.
Figure 22:
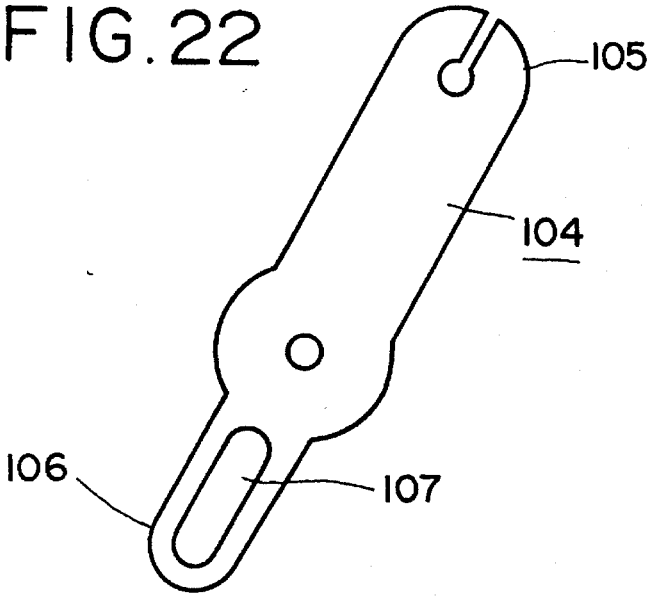
FIG. 22 is a front view of the wire arm.
Figure 23:
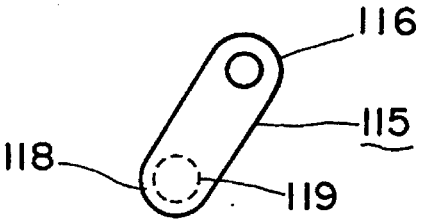
FIG. 23 is a front view of the movement lever.
Figure 24:
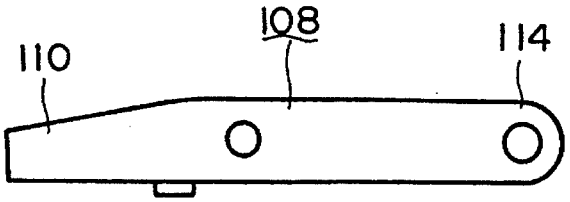
FIG. 24 is a front view of the intermediate lever.

Next, the operation mechanism 9 will be described with reference to FIG. 11 to FIG. 26. The motor 40 and transmission or speed reduction mechanism 59 are secured to a base frame 58 of the mechanism 9. In particular, as shown in FIG. 14, shaft hole **60*a* is formed on left side of the base frame 58, through which hole 60*a* a shaft 60 passes as shown in FIG. 20. In addition, shaft 85 and shaft 60 are overlapped as shown in FIG. 12 and FIG. 13. Open lever 61 (FIG. 15) is rotatably journalled with the shaft 60. The open lever 61 has three legs 62, 68 and 112. The first leg 62 has arc hole 64 with which rod 63 extending to the outer handle 5 of the door 3 engages, and another arc hole 67 with which rod 66 extending to inner handle 65 engaged on 3. The second leg 68 has L shape groove 69. The L shape groove 69 consists of engagement groove 70 extending along a radial direction of the shaft 60 and an idling or invalidity groove 71 extending from front end of the engagement groove 70 and being bent at about a right angle. The third leg 112 has a pin 113. The open lever 61 is urged clockwise in FIG. 12 by means of spring 72 abuts against protrusion 73** of the base frame.

The shaft 60 rotatably supports a transmission lever 74 (FIG. 16) of a shape of about L letter. The first arm 75 of the transmission lever 74 has an oval hole 76 corresponding to engagement groove 70 of the open lever 61. The second arm 77 of transmission lever 74 engages with end portion of the rod 78 extended to the intermediate lever 52 (FIG. 5). Transmission lever 74 is urged clockwise in FIG. 12 by means of spring 79 and abuts against protrusion 73 of the base frame 58.

A lock lever 80 (FIG. 18) exchanging the latch mechanism 8 from its locked condition and an unlocked condition is rotatably journalled with the base frame 58 by a shaft 81. Lock lever 80 is connected to a rod 82 extended to the key cylinder 6 and another rod 83 extended to the inside lock operation member 7. A right end 87 of movement lever 86 is rotatably journalled with arm 84 of the lock lever 80 by a shaft 85. A pin 89 is attached to left end 88 of the movement lever 86 and the pin 89 engages with both oval hole 76 of the transmission lever 74 and L shape groove 69 of the open lever 61.

FIG. 12 and FIG. 13 show the lock lever 80 placed at its unlocked position when the pin 89 engages with both the oval hole 76 of transmission lever 74 and L shape groove 69 of the open lever 61. Consequently, both the open lever 61 and transmission lever 76 are at a condition of connection. As a result, when open lever 61 at its condition as shown in FIG. 13 rotates counterclockwise by means of outer handle 5 or inner handle 65, the transmission lever 74 also rotates counterclockwise in order to rotate the intermediate lever 52 shown in FIG. 5 through the rod 78. Consequently, it is possible to clockwise rotate the ratchet arm 49 to disengage the latch 13 from the ratchet 14.

The lock lever 80 moves to its locked position when it rotates counterclockwise from the position shown in FIG. 12. When the lock lever 80 is moved to its locked position, the pin 89 moves to a front end portion of the engagement groove 70 and faces the invalidity groove 71. Thereby even counterclockwise rotation of the open lever 61 cannot move the pin 89. Accordingly, the transmission lever 74 doesn't rotate and it is not possible to open the door.

A motor 90 for changing positions of the lock lever 80 from its locked position to an unlocked position is secured to the base frame 58. A lever 92 is secured to an output shaft 91 of the motor 90 and a protrusion 93 formed at front end of the lever 92 engages with a fork type portion 94 of the lock lever 80.

Figure 21:
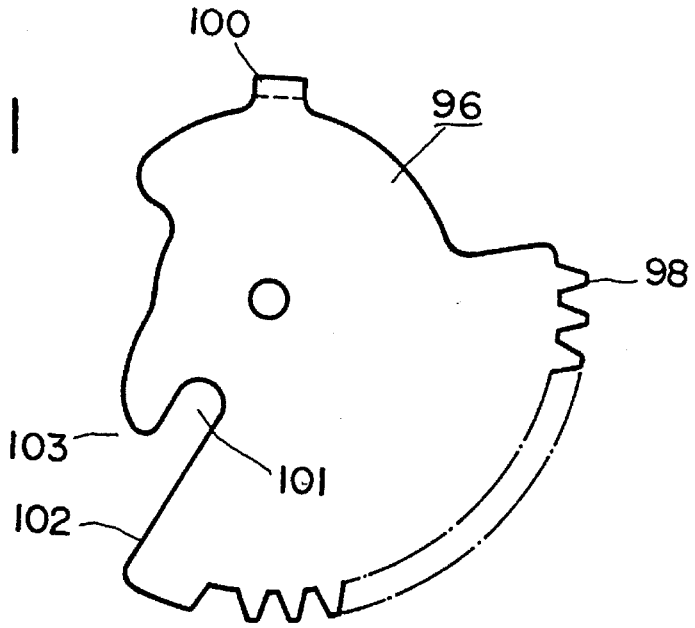
FIG. 21 is a front view of the rotation member.
Figure 25:
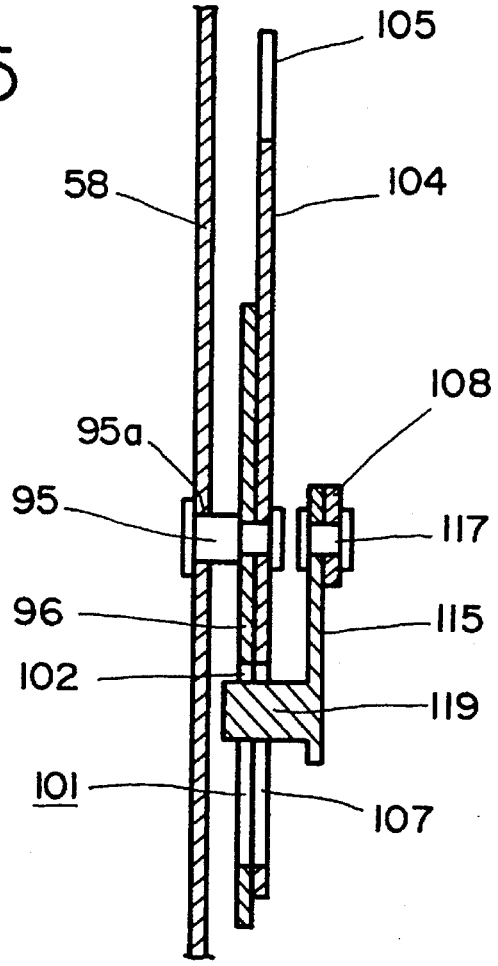
FIG. 25 is a section of the operation lever.

The base frame 58 has a shaft hole 95*a* formed at about center of the frame, through which hole 95*a* a shaft 95 passes as shown in FIG. 25. In FIG. 12, the shaft 95 overlaps with a shaft 117. A rotation member 96 (FIG. 21) is rotatably journalled with the shaft 95. A toothed portion or gear 98 engaging with a drive gear 97 secured to an output shaft of the speed reduction mechanism 59 is provided on periphery of the rotation member 96. The base frame 58 has an arc groove 99 of a radius of shaft hole 95*a* and protrusion 100 integrally formed on rotation member 96 engages with the arc groove 99. FIG. 12 shows an initial position of the rotation member 96. When the motor 40 rightly rotates, rotation member 96 rotates from the position shown along a direction shown by an arrow B. As shown in FIG. 21, rotation member 96 has an engagement groove 101 radially extending to the shaft 95. A side wall 102 of the side walls of the engagement groove 101 has a length longer than the other side wall and the other side wall has a invalidity passage 103.

A wire arm 104 (FIG. 22) is rotatably journalled with the shaft 95. An end portion of the wire 36 extending from latch mechanism 8 engages with one end of the wire arm 104. Another end portion 106 of wire arm 104 has an oval hole 107 corresponding to engagement groove 101 of the rotation member 96.

An intermediate lever 108 is rotatably journalled with the base frame 58 through shaft 109. The intermediate lever 108 is counterclockwise urged in FIG. 12 by spring 111. One end portion 110 of the intermediate lever 108 abuts against the pin 113. Another end 114 of intermediate lever 108 is rotatably journalled with a base end 116 of the movemet lever 115 by shaft 117. Front end 118 of the movement lever 115 has a pin 119 engaging with both of the cut-out groove 101 and oval hole 107.

When open lever 61 abuts against protrusion 73 as shown in FIG. 12 by elasticity of spring 72, one end 110 of intermediate lever 108 abuts against pin 113 of the open lever 61 and a shaft 117 on another end 114 of the intermediate lever 108 corresponds to an axis of shaft 95. At this condition above, pin 119 of the movement lever 115 engages with both engagement groove 101 and oval hole 107, thereby rotation member 96 and wire arm 104 are integrally connected to each other. As a result, when the motor 40 rotates drive gear 97 in order to rotate the rotation member 96 along an arrow B, wire arm 104 also rotates in the arrow B direction, thereby wire 36 is wound up and revolution lever 33 rotates clockwise against force of spring 24.

Figure 26:
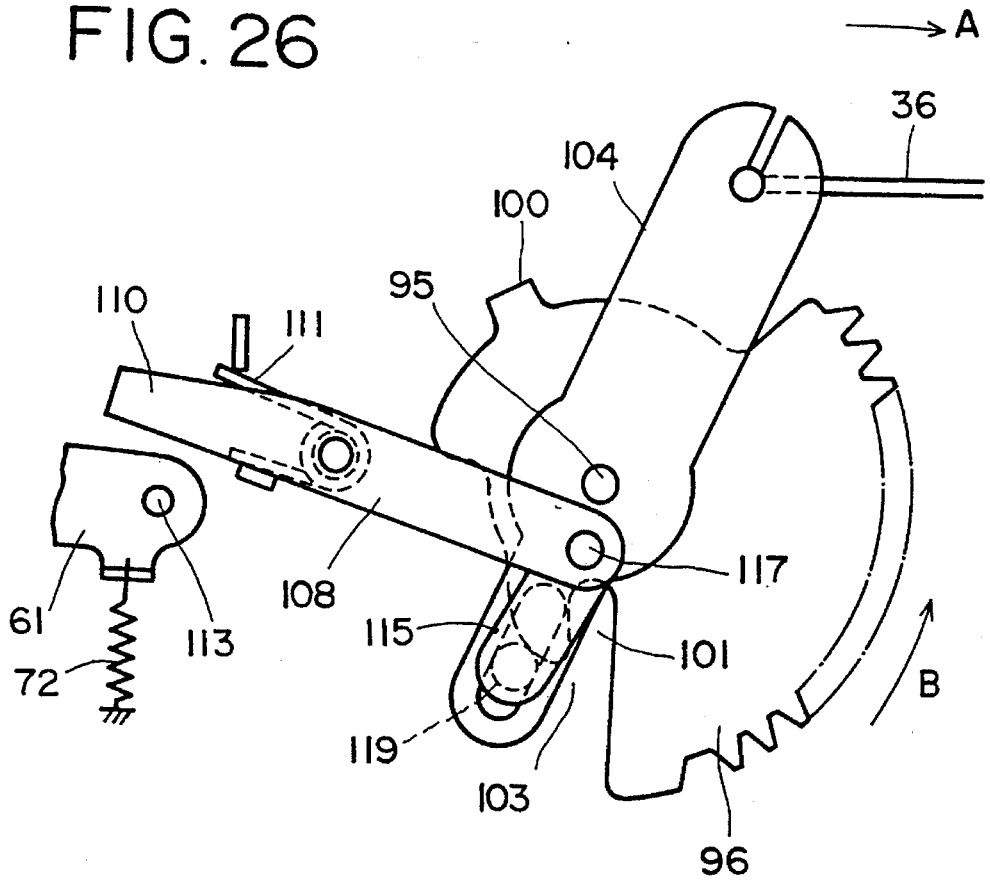
FIG. 26 is an explanation view depicting a condition after the manual safety mechanism operates.

On the contrary, when handle 5 or 65 makes open lever 61 rotate counterclockwise in FIG. 12, intermediate lever 108 is pressed by pin 113 and rotates clockwise around shaft 109, pin 119 of movement lever 115 moves in engagement groove 101 so as to move away from the shaft 95, and is displaced to face the invalidity passage 103. In this condition, the rotation member 96 is disconnected from wire arm 104. As a result, when handle 5 or 65 is operated during operation of motor 40, the rotation member 96 keeps its rotation due to motor 40 along an arrow B as shown in FIG. 26. However, the wire arm 104 returns to its initial position, because a force of resiliency of spring 39 attached to the revolution lever 33 functioning along an arrow A is applied to the wire arm 104 through wire 36. A manual safety mechanism cuts off or breaks such power communication.

The automatic door closing controller 120 is attached to the base frame 58. The controller 120 consists of cable 121 extended to the switch 26, cable 122 to the motor 40, cable 123 to the connector 124, and cable 131 to motor 90 (FIG. 12).

Figure 28B:
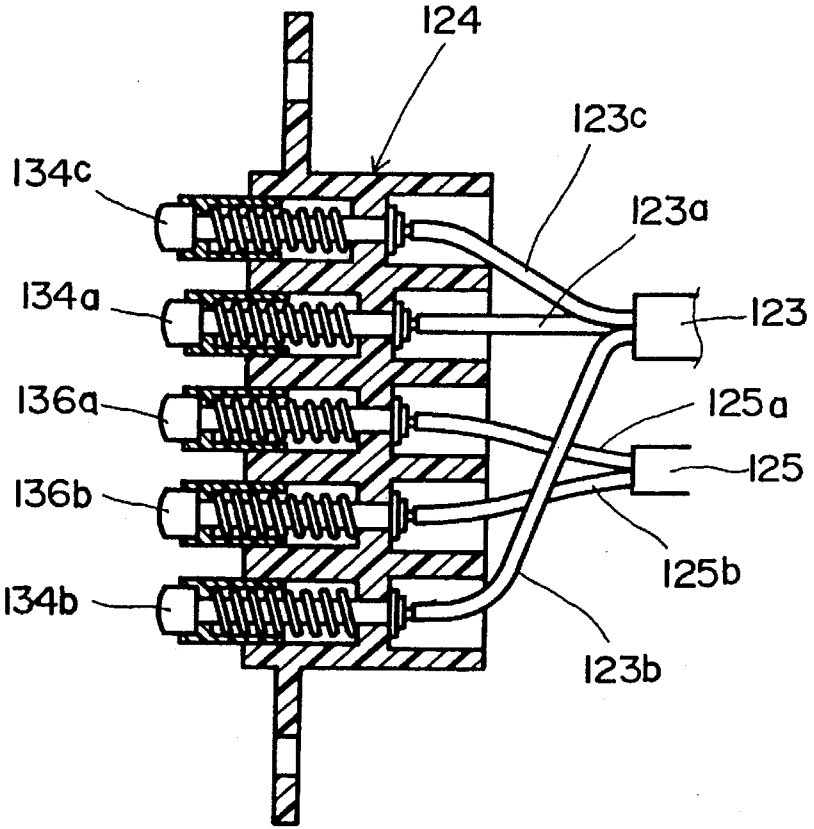
FIGS. 28A and 28B are sections of the connector.
Figure 28A:
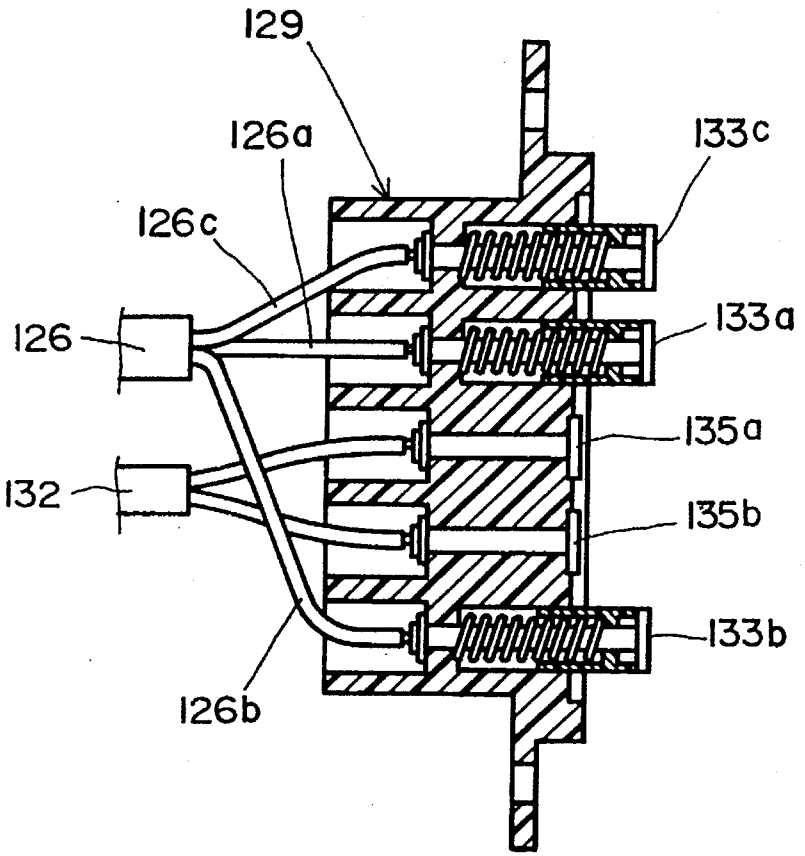

Structures of the connector 124 and another connector 129 will be described with reference to FIG. 27 and FIG. 28. Connector 124 has a plus terminal 134*a* and an earth terminal 134*b*, and signal terminal 134*c*. Respective terminals are connected to three codes 123*a*, 123*b*, and 123*c* of the cable 123 extended to the controller 120. The connector 124 has a pair of terminals 136*a* and 136*b* connected to cable 125 of motor 90 in order to change the lock lever 80. Five terminals of the connector 124, respectively protrude to the outside due to elasticity of spring.

The connector 129 formed on the vehicle body 1 has three terminals 133*a* to 133*c*, respectively corresponding to the terminals 134*a* to 134*c*, and a pair of terminals 135*a* and 135*b* corresponding to terminals 136*a* and 136*b*. Respective terminals 133*a* to 133*c* protrude to the outside by springs and are connected to power supply controller 128 of the body 1 by cords 126*a* to 126*c* of cable 126. The terminals 135*a* and 135*b* are connected to the power supply controller 128 by cable 132.

Terminals 133*a* to 133*c* of the connector 129 and terminals 134*a* to 134*c* of the connector 124 come to contact when the door 3 opens to its predetermined position. This contact is made before the latch 13 engages with the striker 10 into its half-latched condition. Contact time is not strictly determined. For example, these terminals to come to mutually contact when the striker 10 enters the passage 17.

According to function of the power supply controller 128, contact detection voltage is applied to signal terminals 133*c* through the cords 126*c* when the terminals 133*a* to 133*c* come into contact with the terminals 134*a* to 134*c*. Then electricity is impressed from signal terminal 133*c* to automatic door closing controller 120 through signal terminal 134*c* and returned to earth terminal 133*b* of the body 1 through earth terminal 134*b* of the door 3. That is, no electricity is impressed to signal terminal 133*c* of the body 1 when the door is open since the signal terminal 133*c* is free end, however, when terminals come to contact to each other making an electricity loop, electricity flows therethrough. When electricity flows, the power supply controller 128 determines that connectors come to contact to each other and supplied electricity of battery 127 to plus terminal 133*a* through the cord 126*a*. Consequently, electricity necessary to rotate or drive the motor 40 is supplied to the automatic door closing controller 120.

As described above, according to the present invention, mutual contact of connectors is detected by electricity flowing attained by practical contact of the connectors, so it is reliable to detect. In addition, because exposed or naked structure of the switch is not used, it is possible to obtain high reliability of the function.

Because that respective terminals of the connector 124 and 129 are provided at a naked condition, it is necessary to separate the plus terminal 133*a* from the earth terminal 133*b* preventing these terminals 133*a* and 133*b* from accidently contacting to each other making a short circuit. Between the plus terminal 133*a* and the earth terminal 133*b*, there are terminals 135*a* and 135*b*, respectively connected to the motor 90 to change the locking condition. Respective terminals 134*a* to 134*c* and 136*a* to 136*b* at a side of the connector 124 are so arranged as to match with the structure of the connector 129.

The automatic door closing controller 120 has a detector 130 for detecting rotation condition of the motor 40. According to the door lock device of the present invention, the detector 130 uses an ammeter to detect electricity flown in the motor and know rotation and halt of the motor 40. The structure of detector is not restricted to that of the detector 130 and various kinds of the detector may be employed.

Operation of Automatic Door Closing

Because the connector 124 of the door 3 doesn't come to contact with another connector 129 of body 1 while door is open, no electricity is being supplied to automatic door closing controller 120 of the door 3. And because the latch 13 is placed at its open position, the switch 26 is at its OFF condition. In practise, electricity is not supplied to controller 120 and the switch 26 fails to function. Power supply controller 128 of vehicle body 1 is impressing voltage to signal terminal 133*c* through cord 126*c* of the connector 129 in order to detect the contact condition.

Figure 29:
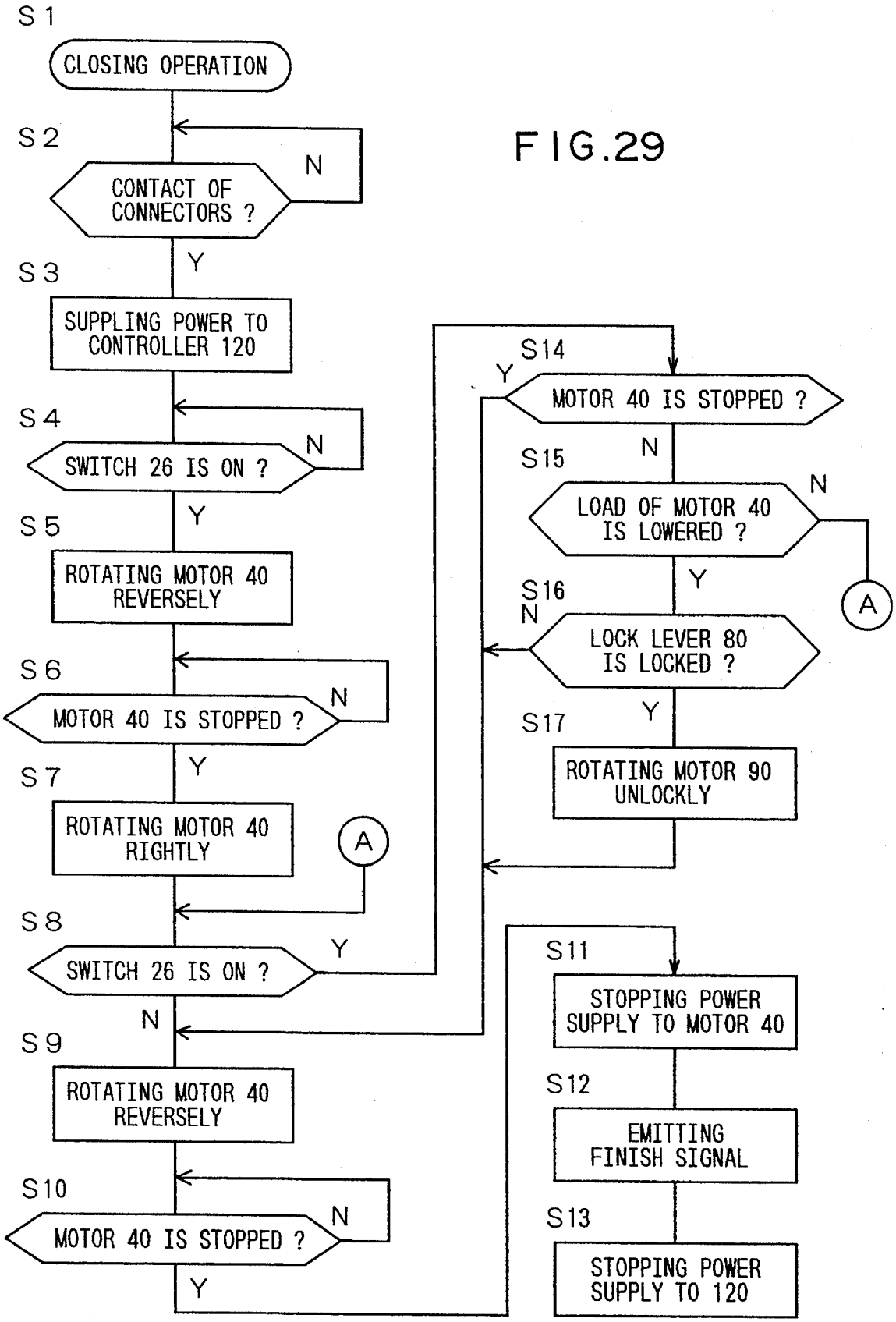
FIG. 29 is a flow chart.
Figure 30:
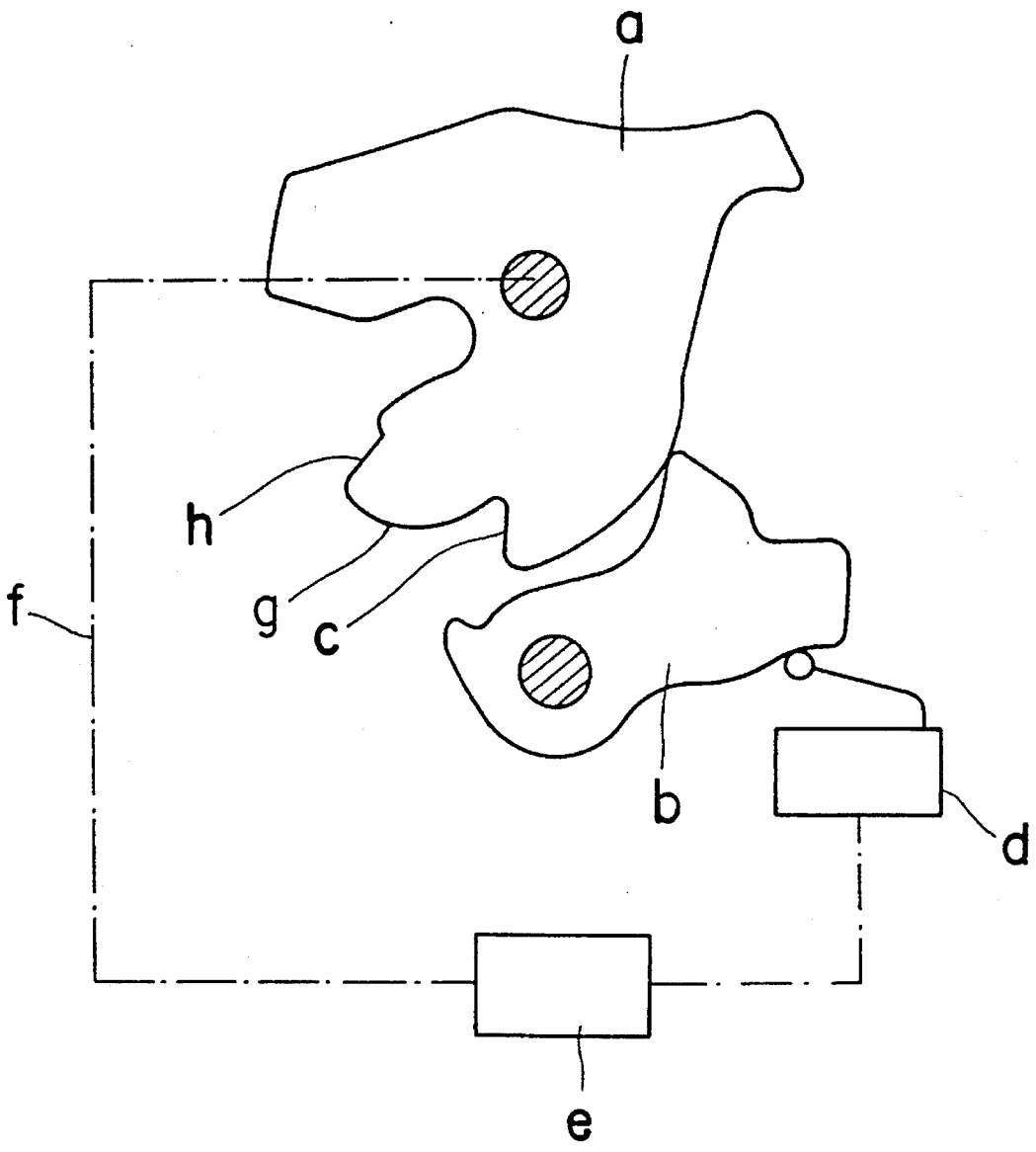
FIG. 30 (PRIOR ART)
FIG. 30 is a mechanism of the prior art.

When the slide type door 3 is manually slide along its opening direction, terminals 134*a–c* of connector 124 and terminals 133*a–c* of connector 129 contact before the latch 13 reaches its half-latched position. Then, voltage applied to the signal terminal 133*c* flows electricity from signal terminal 133*c* to automatic door closing controller 120 through signal terminal 134*c*. Then, electricity returns to earth terminal 133*b* of the vehicle body 1 through the earth terminal 134*b* of door 3. As described above, when electricity flows, it is determined by power supply controller 128 that the connectors have contact each other and the power of battery 127 is supplied to automatic door closing controller 120 through plus terminals 133*a* and 134*a* at Step 3 of the flow chart shown in FIG. 29.

The controller 120 confirms the position of latch 13 by means of the signal sent from the switch 26 and is kept at its present condition until the latch 13 reaches its half-latched condition at Step 4. When door 3 further moves by its inertia and the latch 13 rotates to its half-latched position shown in FIG. 8, the bent portion 27 of latch arm 25 connected to latch 13 via stepped pin 21 presses the switch arm 28 of switch 26 turning the switch 26 ON.

When the switch 26 is turned ON, the controller 120 supplies electricity to reversely rotate the motor 40 at Step 5 in order to rotate the rotation member 96 along a counterclockwise direction as shown in FIG. 12 and return the rotation member 96 to its initial position. After rotation member 96 returns to its initial position, protrusion 100 of the rotation member 96 abuts against end portion of arc groove 99 of the base frame 58 attaining a mechanical-locked condition and stepping the motor 40. As a result, electricity flowing to the motor 40 changes and such change is directed by a detector 130 at Step 6.

When the rotation member 96 returns to its initial position, controller 120 supplies electricity to rotate rightly the motor 40 in order to rotate the rotation member 96 along an arrow B at Step 7. Then pin 119 of the movement lever 115 engages with both engagement groove 101 of rotation member 96 and oval hole 107 of the wire arm 104, so that also wire arm 104 rotates along an arrow B direction to wind up the wire 36 and the revolution lever 33 rotates clockwise in FIG. 5.

When revolution lever 33 rotates, the cooperation lever 41 rotates counterclockwise in FIG. 4 through rotation shaft 32 and the pressing body 42 is guided by groove 47 and moves to the right. Then, roller 46 of the pressing member 42 abuts against an engagement piece 48 of the latch 13 placed at its half-latched position so as to compulsorily rotate clockwise the latch 13 being replaced to its full-hatched position. However, when the latch 13 is kept at its full-latched position, the switch 26 is yet at its ON position, so that motor 40 rotates continuously and latch 13 rotates over its full-latched position as shown in FIG. 10. Then, switch 26 is turned to OFF at Step 8.

When switch 26 is turned to OFF, controller 120 considers that latch 13 has rotated to its overrun position. Thus, the motor 40 is reversely rotated at Step 9. Consequently, rotation member 96 and wire arm 104 rotate along counterclockwise direction B, thereby wire 36 is is loosened, revolution lever 33 rotates counterclockwise due to elasticity of spring 39, and the pressing body 42 returns to its original position. In addition, latch 13 overrun returns to its full-latched position due to elasticity of spring 24 and main stepped portion 31 of the latch 13 engages with ratchet 14.

Reverse rotation of motor 40 makes rotation member 96 return to its initial position, thereby protrusion 100 of the rotation member 96 abuts against end portion of arc groove 99 of base frame 58 attaining a mechanical locked condition and stopping the motor 40.

As a result, electricity flown to motor 40 changes and detector 130 detects such change at Step 10. Thus, controller 120 stops electricity supply to the motor 40 at Step 11 and finish or end signal is sent to power supply controller 128 of vehicle body 1. When power supply controller 128 receives finish signal, it stops electricity supply to plus terminal 133*a* at Step 13.

Safety Mechanism

While power of motor 40 moves the latch 13 from its half-latched position to full-latched position, the switch 26 is kept at ON condition at Step 8. Then, the detector 130 monitors rotary condition of motor 40 at Step 14. If it detects halt of motor 40, it is considered as happening of emergency and instantly the motor 40 is reversely rotated at Step 9. An emergency means that foreign matter is caught in the door 3 while the door is being closed and the motor 40 stops, and the switch 26 doesn't work well failing to detect overrun or overrotation of the latch 13.

Additionally, when a hand is caught in the door 3 while the door is automatically closing, detector 130 detects such problem of the motor 40 makes the motor 40 rotate reversely. However, it is necessary to positively operate the automatic manual mechanism before the controller 120 functions its automatic safety controlling operation.

According to the door lock apparatus of the present invention, when hand is caught in the door 3, instantly or as soon as possible outer handle 5 or inner handle 65 is operated in order to rotate the open lever 61. Then, pin 113 of the open lever 61 makes shaft 109 of the intermediate lever 108 rotate clockwise around shaft 109, pin 119 of the movement lever 115 disengages from the engagement groove 101 of rotation member 96 and moves to a position facing the invalidity passage 103.

As a result, because that rotation member 96 and wire arm 104 which have been connected through pin 119 are disconnected, then power of motor 40 is not transferred to wire arm 104 and automatic door closing operation of power stops. As described above, after the rotation member 96 is disconnected from the wire arm 104, load of the motor 40 lowers suddenly resulting in change of current value or rotation number. When such change is detected by detector 130 at Step 15, controller 120 considers it is a result of operation of manual safety mechanism and confirms the position of lock lever 80 at Step 16. When the lock lever 80 is at its unlocked position, the motor 40 immediately is reversely rotated at Step 9.

Necessity of confirmation of position of the lock lever 80 will be explained. When the lock lever 80 is at its unlocked position and the manual safety mechanism functions, the open lever 61 rotates and transmission lever 74 also rotates through pin 89 resulting in rotation of intermediate lever 52 shown in FIG. 5 through rod 78. End portion 55 of the intermediate lower 52 rotated comes to contact with another end portion 56 of the ratchet arm 49 in order to rotate the ratchet arm 49 and also the ratchet 14 connected to the ratchet arm 49 through connection pin 51. As a result, ratchet 14 is disengaged from latch 13. When manual safety mechanism is operated in unlocked condition of the lock lever 80, automatic door closing operation by the motor 40 stops and the door 3 will open.

On the contrary, when lock lever 80 is at its locked position, even if open lever 61 rotates, the transmission lever 74 doesn't rotate and it is impossible to disengage ratchet 14 from the latch 13. Accordingly, even if latch 13 reversely rotates to an open position due to resiliency of spring 24 after the latch 13 is made free from motor 40, ratchet 14 engages with sub-stepped portion 29 becoming the latch 13 of its half-latched condition failing to open the door. This is a problem of the prior art.

In order to solve such problem of the conventional door lock apparatus by the present invention, when the manual safety mechanism operates, position of the lock lever 80 is confirmed. When lock lever 80 is placed at its locked position, controller 120 impresses electricity on motor 90 to exchange lock lever 80 at its unlocked position at Step 17. As stated above, when lock lever is at its locked position and manual safety mechanism operates, automatic door closing operation by motor 40 stops, as well as lock ever 80 exchanges to unlocked position. Then, again handle 5 or 65 is operated to rotate the open lever 61 and the door 3 is able to open since the lock lever 80 has been at its unlocked position. In short, at any situation, only handle 5 or 65 is operated twice, the door 3 is madeable to open.

Door Re-closing Operation after Manual Safety Mechanism Operation

When outer handle or inner handle operates to manual safety mechanism while motor 40 automatically closes the door, compulsory closing of door stops and also the door 3 opens. When door 3 is open, connector 129 at the vehicle body 1 and connector 124 at door 3 are apart from each other, so that at this instant of separation electricity supply to controller 120 stops. As a result, motor 40 becomes of no power and rotation member 96 stops at its mid position. In addition, when operation of manual safety mechanism moves pin 119 into the invalidity passage 103 of the rotation member 96, wire arm 104 is pulled along arrow A direction through wire 36 owing to elasticity of spring 39 attached to revolution lever 33 and returns to initial position of wire arm 104. FIG. 26 depicts condition of wire arm 104 at its original position. As clearly shown in FIG. 26, when the rotation member 96 stops at its mid position, pin 119 is kept at its engaged position with invalidity passage 103. In this situation, even if motor 40 is again impressed and the rotation member 96 rotates along arrow B direction, rotation member 96 fails to move the pin 119 resulting in non-operation of automatic door closing.

According to the present invention, as already described concerning operation of automatic door closing, the motor 40 reversely rotates at Step 5 in order to once rotation member 96 return to its initial position. When rotation member 96 is adapted to return to the initial position, pin 119 engaged with the invalidity passage 103 enters engagement groove 101 owing to elasticity of spring 111 and rotation member 96 is again connected to wire arm 104 attaining a condition in which automatic door closing is possible.

Operation of Manual Door Closing

Next, it will be explained on manual door closing. When the slide type door 3 in its open condition is slided strongly by hand, latch 13 of the latch mechanism 8 engages with striker 10 of the vehicle body 1 as well known by every person due to large inertia of the door 3, and the latch 13 rotates to its full-latched position. Then, ratchet 14 engages with the main stepped portion 31 of the latch 13 and the door 3 is closed without power of motor 40.

In manual door closing operation, the switch 26 exchanges in anytime according to rotation of latch 13 and controller 120 accordingly controls the motor 40. In automatic door closing operation, the switch 26 instantly changes, so that completion of operation is considered and the motor 40 starts its reverse rotation after motor 40 moves for few rotation.

Other Operation

When the slide type door 3 is closed, although the latch 13 engaged with striker 10 rotates once to its half-latched position, ratchet 14 sometime cannot engage with sub stepped portion 29 of latch 13 and latch 13 returns owing to elasticity of spring 24 to its open position. According to the present invention, the motor 40 is adapted to rightly rotate while the switch 26 is substantially at its ON condition, so that latch 13 disengaging with the striker 10 is not rotated to full-latched position even while such condition above.

What is claimed is:

1. A door lock apparatus with automatic door closing mechanism comprising:

a latch engaging with a striker secured to a vehicle body;

an automatic door closing motor for over-rotating said latch at a half-latched position beyond a full-latched position while the motor rightly rotates;

a switch which is continuously in an ON condition when the latch is between the half-latched position and the full-latched position and is turned to an Off condition when the latch is at a position other than between the half-latched position and the full-latched position; and a controller for rightly rotating said motor when a door is closed and turns said switch from the OFF condition to the On condition and reverses rotation of the motor when the switch turns from the ON condition to the OFF condition.

2. The door lock apparatus with automatic door closing mechanism according to claim 1, wherein said controller reverse rotates the motor and then rightly rotates the motor when closing of the door turns the switch from OFF condition to ON condition.

3. The door lock apparatus with automatic door closing mechanism according to claim 1, further comprising a power communicating mechanism provided between the motor and the latch, wherein said controller reverses rotation of the motor when closing of the door turns the switch from OFF condition to ON condition, and rightly rotates the motor after the power communicating mechanism returns to an initial position.

4. A door lock apparatus with automatic door closing mechanism comprising:

a latch engaging with a striker secured to a vehicle body;

an automatic door closing motor;

a power communicating mechanism provided between the motor and the latch so as to rotate compulsorily the latch along a full-latched direction when the motor rightly rotates;

a switch detecting the latch at a half-latched position and a full-latched position; and a controller controlling the motor due to a signal sent from the switch; wherein said controller rotating the motor in reverse when the switch detects the latch at the half-latched position to return the power communication mechanism to an initial position, then rightly rotating the motor, and rotate the motor in reverse when the switch detects the latch at the full-latched position.

5. The door lock apparatus with automatic door closing mechanism according to claim 4, wherein the motor moves to a mechanical-locked condition and stops rotation when the power communication mechanism returns to the initial position, and the controller having a detector for detecting a rotary condition of the motor.

6. The door lock apparatus with automatic door closing mechanism according to claim 5, wherein the controller rotates the motor in reverse when the detector detects a stoppage condition of the motor before the switch detects the latch at the full-latched position.

7. A door lock apparatus with automatic door closing mechanism comprising:

a latch engaging with a striker secured to a vehicle body;

a ratchet engaging with said latch so as to hold an engagement of the latch with the striker;

a first motor;

a power communication mechanism provided between the first motor and the latch so as to compulsorily rotate the latch along a full-latched direction when the motor rightly rotates;

a switch detecting the latch at a half-latched position and a full-latched position;

a controller rightly rotating the motor when the switch detects the latch at the half-latched position and rotating the motor in reverse when the switch detects the latch at the full-latched position;

an open lever disengaging the ratchet from the latch;

a lock lever changing from a locked position and an unlocked position so as to make operation of the ratchet at locked position thereof by the open lever impossible; and a second motor changing the lock lever from the locked position to the unlocked position;

said power communication mechanism having a safety mechanism disconnecting the first motor from the latch when the open lever operates, and said controller controlling the second motor so as to change the lock lever to the unlocked position when the safety mechanism operates.

8. The door lock apparatus with automatic door closing mechanism according to claim 7, wherein said controller has a detector detecting a rotary condition of the first motor, and said controller considering a change of rotation number of the first motor detected by the detector and due to a lowering of load as operation of the safety mechanism.

9. A door lock apparatus on a door which slides on a vehicle body so as to be open and closed, comprising;

a latch mechanism provided at a rear end portion of the door;

said latch mechanism having a latch engaging with a striker secured to said vehicle body;

a ratchet engaging with the latch so as to hold an engagement of the latch with the striker, an operation mechanism provided on a front side of the door;

said operation mechanism having an automatic door closing motor, an output member driven by the motor, a wire arm indirectly connected to the latch by wire, and a connection member connecting the wire arm to the output member;

wherein when the output member rotates the motor the latch rotates toward the full-latch position via the wire;

a first connector provided on the vehicle body and connected to a battery on the vehicle body;

a second connector provided on the door and contacting the first connector when the door moves to close at a predetermined position; and a controller connected to the second connector to control the motor;

said operation mechanism further having an open lever connected to a handle to open the door, said open lever being indirectly connected to the ratchet through a rod, and said connection member disconnecting the wire arm from the output member when the open lever rotates.

10. A door lock apparatus on a door which slides on a vehicle body so as to be open and closed, comprising:

a power supply unit provided on the vehicle body and having a first controller connected to a battery and a first connector connected to the first controller, said first connector having a first terminal group consisting of a plus terminal exposed to the outside, an earth terminal and a signal terminal;

a power receiving unit provided on the door and having a second connector and a second controller connected to the second connector, said second connector having a second terminal group consisting of a plus terminal exposed to the outside, an earth terminal, and a signal terminal, said second terminal group contacting the first terminal group when the door is closed to a predetermined position;

a latch provided on the door so as to engage with a striker secured to the vehicle body;

a first motor connected to the second controller so as to rotate the latch along a full-latched direction wherein the motor rightly rotates;

wherein the first controller impresses a voltage on the signal terminal of the first terminal group and provides electricity to the earth terminal of the first terminal group from the signal terminal of the first terminal group through the second controller when the first terminal group comes into contact with the second terminal group, and said first controller supplies power from the battery to the second controller, when the first controller provides electricity to the earth terminal, through each said plus terminal.

11. The door lock apparatus according to claim 10, wherein each plus terminal is respectively placed relatively near the signal terminal and the earth terminal is placed apart from the plus terminal or signal terminal by a predetermined gap.

12. The door lock apparatus according to claim 11, further comprising an open lever disengaging the latch from the striker, a lock lever which changes between a locked position and an unlocked position and makes operation of the open lever impossible when the lock lever is changed to the locked position, a second motor changing the lock lever between the locked position and the unlocked position, said second connector having a third terminal group connected to the second motor, the third terminal group being placed in a predetermined gap, and the first connector has a fourth terminal group corresponding to the third terminal group.

* * * * *